US007522740B2

(12) United States Patent
Julstrom et al.

(10) Patent No.: US 7,522,740 B2
(45) **Date of Patent: *Apr. 21, 2009**

(54) MULTI-COIL COUPLING SYSTEM FOR HEARING AID APPLICATIONS

(75) Inventors: Stephen D. Julstrom, Chicago, IL (US); Viorel Drambarean, Skokie, IL (US); Willem Soede, JL Leiden (NL)

(73) Assignee: Etymotic Research, Inc., Elk Grove Village, IL (US)

( * ) Notice: Subject to any disclaimer, the term of this patent is extended or adjusted under 35 U.S.C. 154(b) by 340 days.

This patent is subject to a terminal disclaimer.

(21) Appl. No.: 11/345,567

(22) Filed: Feb. 1, 2006

(65) Prior Publication Data

US 2006/0269088 A1 Nov. 30, 2006

Related U.S. Application Data

(63) Continuation of application No. 10/356,290, filed on Jan. 31, 2003, now Pat. No. 7,099,486, which is a continuation-in-part of application No. 09/752,806, filed on Dec. 28, 2000, now Pat. No. 6,694,034.

(60) Provisional application No. 60/225,840, filed on Aug. 16, 2000, provisional application No. 60/174,958, filed on Jan. 7, 2000, provisional application No. 60/123,004, filed on Mar. 5, 1999.

(51) Int. Cl.
*H04R 25/00* (2006.01)

(52) U.S. Cl. ..... 381/331; 381/322; 381/315

(58) Field of Classification Search ..... 381/312, 381/315, 322, 324, 326, 327, 330, 331
See application file for complete search history.

(56) References Cited

U.S. PATENT DOCUMENTS

| | | | | |
|---|---|---|---|---|
| 4,142,072 | A | 2/1979 | Berland | |
| 5,210,803 | A | 5/1993 | Martin et al. | |
| 5,606,621 | A * | 2/1997 | Reiter et al. | 381/328 |
| 5,710,820 | A | 1/1998 | Martin et al. | |
| 5,737,430 | A | 4/1998 | Widrow | |
| 5,749,912 | A | 5/1998 | Zhang et al. | |

(Continued)

FOREIGN PATENT DOCUMENTS

SE 9804504 A * 6/2000

OTHER PUBLICATIONS

Skinner M W, "Hearing Aid Evaluation", Prentice Hall, 1988, pp. 222-225.

(Continued)

*Primary Examiner*—Brian Ensey
(74) *Attorney, Agent, or Firm*—McAndrews, Held & Malloy, Ltd.

(57) ABSTRACT

A hearing improvement device using a multi-coil coupling system and methods for operating such a device are disclosed. An embodiment of the present invention may use an array microphone to provide highly directional reception. The received audio signal may be filtered, amplified, and converted into a magnetic field for coupling to the telecoil in a conventional hearing aid. Multiple transmit inductors may be used to effectively couple to both in-the-ear and behind-the-ear type hearing aids, and an additional embodiment is disclosed which may be used with an earphone, for users not requiring a hearing aid.

28 Claims, 39 Drawing Sheets

Right Ear Assembly

U.S. PATENT DOCUMENTS

| | | | | |
|---|---|---|---|---|
| 5,793,875 | A | 8/1998 | Lehr et al. | |
| 5,796,821 | A | 8/1998 | Crouch et al. | |
| 5,835,610 | A | 11/1998 | Ishige et al. | |
| 6,157,728 | A | 12/2000 | Tong et al. | |
| 6,208,740 | B1 | 3/2001 | Grever | |
| 6,320,959 | B1 | 11/2001 | Crouch et al. | |
| 6,424,721 | B1 * | 7/2002 | Hohn | 381/328 |
| 6,438,245 | B1 | 8/2002 | Taenzer et al. | |
| 6,516,075 | B1 | 2/2003 | Jacobs et al. | |
| 6,546,109 | B1 | 4/2003 | Gnecco et al. | |
| 6,700,983 | B1 | 3/2004 | Geskov-Jensen et al. | |
| 6,888,949 | B1 * | 5/2005 | Vanden Berghe et al. | 381/312 |
| 7,099,486 | B2 | 8/2006 | Julstrom et al. | |
| 2001/0055386 | A1 | 12/2001 | Waldron et al. | |
| 2002/0141545 | A1 | 10/2002 | Segovia | |

OTHER PUBLICATIONS

Studebaker G A et al, "The Vanderbilt Hearing-Aid Report: State of the Art—Research Needs: Telephone Coupling", Monographs in Contemporary Audiology, 1982, pp. 91-93.

Valente, M, Ed., "Hearing Aids: Standards, Options, and Limitations", Thieme Medical Publishers, Inc., 1996, pp. 40-50.

(product announcement), "Centrum Sound Offers Oticon System", The Hearing Journal, vol. 46 No. 10, Oct. 1993, p. 80.

(product announcement), "Public-Use Hearing Device From Four Point Design", The Hearing Journal, vol. 45 No. 4, Apr. 1992, p. 52.

(product literature), "Audex—The Chaamp", known to be available at Internet URL <http://www.audex.com.html> on Jan. 23, 2003, 3 pages.

(product literature), "Sennheiser—EZI 120 Induction Coupler", known to be available at Internet URL <http://buy.sennheiserusa.com/asp/Sennheiser/pdf/EZI120EZT1011EZT100.pdf> on Jan. 23, 2003, 1 page.

(product literature), "Amplifiers for Cell Phones", known to be available at Internet URL <http://www.hacofamerica.com/cellamp.htm> on Jan. 23, 2003, 5 pages.

(product literature), "Hearing Aid Telephone Interconnect Systems—Products", known to be available at Internet URL <http://www.hatis.com/> on Jan. 13, 2003, 9 pages.

(product literature), "GN Transistor—Products (English)", known to be available at Internet URL < http://www.transistor.se/transistor/ald/en/index.htm > on Jan. 23, 2003, 10 pages.

Japanese advertisement showing t-hook style coupler, place of original publication unknown, published prior to Jan. 23, 2003.

(advertisement), "GN Transistor—T-hook", ENTNews, vol. 10 No. 2, May/Jun. 2001, 2 pages, front cover and unknown advertisement page.

Ross M, Ph.D., "Telecoils and Telephones", known to be available at Internet URL <http://www.hearingresearch.org/Dr.Ross/telecoil_and_telephones.htm> on Jan. 23, 2003, 7 pages.

Ross M, Ph.D., "Beyond Hearing Aids: Hearing Assistance Technologies", known to be available at Internet URL <http://www.hearingresearch.org/Dr.Ross/beyond_hearing_aids.htm> on Jan. 23, 2003, 17 pages.

(unknown),"Getting Hard of Hearing People 'In The Loop'" Internet Web Page, known to be available at Internet URL <http://www.hearingloop.org/> on Jan. 23, 2003, 2 pages.

Myers D G, Ph.D., "The Hearing Review: The Coming Audiocoil Revolution", known to be available at Internet URL <http://www.assistiveaudio.com/Hearing%20Review%20Sept%202002%20Dave%20Myers.htm> on Jan. 23, 2003, 8 pages.

Wilson B J, "Why Don't Cell Phones Work with Hearing Aids?", known to be available at Internet URL <http://www.geocities.com/Heartland/Prairie/4727/bbhcellemi.htm> on Jan. 23, 2003, 2 page.

Boswell S, "Finding A HAC Cell Phone", known to be available at Internet URL <http://www.geocities.com/Heartland/Prairie/4727/bbhcellsurvery.htm> on Jan. 23, 2003, 3 pages.

Brosman F W, "Telecoils and The Magnetic Loop", known to be available at Internet URL <http://www.saywhatclub.com/newsletter/jun02/wes.htm> on Jan. 23, 2003, 2 pages.

Revit L, "Proper Use of Telecoils: It's as easy as 1,2,3 . . . 4!", known to be available at Internet URL <http://www.frye.com/library/application/larry04.html> on Jan. 23, 2003, 2 pages.

(unknown author), "Pennsylvania Self Help for Hard of Hearing People: Position on Telecoils", known to be available at Internet URL <http://trfn.clpgh.org/shhh/Position/tcoil.htm> on Jan. 23, 2003, 3 pages.

Davidson S A et al, "Programmable Telecoil Responses: Potential Advantages for Assistive Listening Device Fittings", known to be available at Internet URL <http://www.hearing-loss-help-co.com/telecoils.htm> on Jan. 23, 2003, 6 pages.

(unknown author), "Telecoils in Hearing Aids in the USA", known to be available at Internet URL <http://www.hohadvocates.org/telecoils.htm> on Jan. 23, 2003, 5 pages.

(product data sheet), "P/No. PH1-BP1—Microphone Cable for Silhousette Inductor", Mutech International Co., Inc., Top Hill 201, 7-4, 2-Chome Haramachida, Machida-City, Tokyo 194, Japan, dated Sep. 25, 2002, 2 pages.

(product data sheet), "P/N YA-180643C—Silhouette Inductor", Mutech International Co., Inc., Top Hill 201, 7-4, 2-Chome Haramachida, Machida-City, Tokyo 194, Japan, dated Mar. 8, 2001, 2 pages.

(product data sheet), "Silhouette Inductor Coil Testing Method", Mutech International Co., Inc., Top Hill 201, 7-4, 2-Chome Haramachida, Machida-City, Tokyo 194, Japan, dated Oct. 1, 2002, 1 page.

* cited by examiner

Left Ear Assembly

Right Ear Assembly

MULTI-COIL COUPLING SYSTEM FOR HEARING AID APPLICATIONS

CROSS-REFERENCE TO RELATED APPLICATIONS/INCORPORATION BY REFERENCE

This application is a continuation of prior U.S. patent application Ser. No. 10/356,290 entitled "Multi-Coil Coupling System For Hearing Aid Applications" filed Jan. 31, 2003 now U.S. Pat. No. 7,099,486, which is itself a continuation in part of U.S. patent application Ser. No. 09/752,806, entitled "Transmission Detection and Switch System for Hearing Improvement Applications", filed on Dec. 28, 2000 now U.S. Pat. No. 6,694,034, that in turn makes reference to, claims priority to, and claims the benefit of U.S. Provisional Patent Application Ser. No. 60/174,958 filed Jan. 7, 2000, Ser. No. 60/225,840 filed Aug. 16, 2000, and Ser. No. 60/123,004 filed Mar. 5, 1999, the complete subject matter of each of which is hereby incorporated herein by reference, in its entirety.

This application also makes reference to U.S. Pat. No. 6,009,311, issued Dec. 28, 1999, the complete subject matter of which is hereby incorporated herein by reference in its entirety.

FEDERALLY SPONSORED RESEARCH OR DEVELOPMENT

[N/A]

MICROFICHE/COPYRIGHT REFERENCE

[N/A]

BACKGROUND OF THE INVENTION

Numerous types of hearing aids are known and have been developed to assist individuals with hearing loss. Examples of hearing aid types currently available include behind the ear (BTE), in the ear (ITE), in the canal (ITC) and completely in the canal (CIC) hearing aids. In many situations, however, hearing impaired individuals may require a hearing solution beyond that which can be provided by such a hearing aid using it's internal microphone alone. For example, hearing impaired individuals often have great difficulty carrying on normal conversations in noisy environments, such as parties, meetings, sporting events or the like, involving a high level of background noise. In addition, hearing impaired individuals also often have difficulty listening to audio sources located at a distance from the individual, or to several audio sources located at various distances from the individual and at various positions relative to the individual.

The characteristics and location of a hearing aid internal microphone often results in excessive pickup of ambient acoustical noise. In the past, this has often been overcome by the direct magnetic coupling of a speech signal into a "telecoil", which is often incorporated internally in hearing aids. The telecoil's original purpose was to pick up the stray magnetic field from conventional telephone receivers, which often, although not always, had sufficient strength for efficient direct coupling of the telephone signal. The telecoil's use has expanded to use a receiver in "room loop" systems, where a large room is "looped" with sufficient audio signal-driven cabling to create a reasonably uniform, generally vertically oriented magnetic field within the room. The telecoil has also been used to receive magnetically coupled audio signals from special "neck loops" and thin "silhouette"-style "tele-couplers" fit behind the ear, next to a BTE aid.

A common problem with prior art tele-couplers of the neck loop and silhouette styles has been the difficulty of bathing the telecoil in a magnetic field that is both of sufficient strength and sufficient uniformity in relation to typical relative tele-coupler/telecoil positionings so as ensure a predictable, consistent audio coupling at a volume level that is adequate for comfortable use and that can consistently overcome environmental magnetic noise interference. Additionally, silhouette-style tele-couplers, which are generally designed with BTE aids in mind, have not successfully achieved sufficient field strength at the greater distance needed to reach ITE telecoils, or provided the appropriate field orientation for optimum coupling.

Further, the net frequency response obtained with prior art tele-coupler/telecoil systems has been uncontrolled, unpredictable, and generally not uniform. The combination of the non-uniform frequency characteristics of the field produced by the typical transmitting inductor and the non-uniform frequency response of the typical receiving telecoil results in unsatisfactory overall frequency response for the user.

Further limitations and disadvantages of conventional and traditional approaches will become apparent to one of skill in the art, through comparison of such systems with some aspects of the present invention as set forth in the remainder of the present application with reference to the drawings.

BRIEF SUMMARY OF THE INVENTION

A device, method and/or system for providing hearing improvement, substantially as shown in and/or described in connection with at least one of the figures, as set forth more completely in the claims."

These and other advantages, aspects, and novel features of the present invention, as well as details of illustrated embodiments, thereof, will be more fully understood from the following description and drawings.

DETAILED DESCRIPTION OF THE INVENTION

Figure 1:
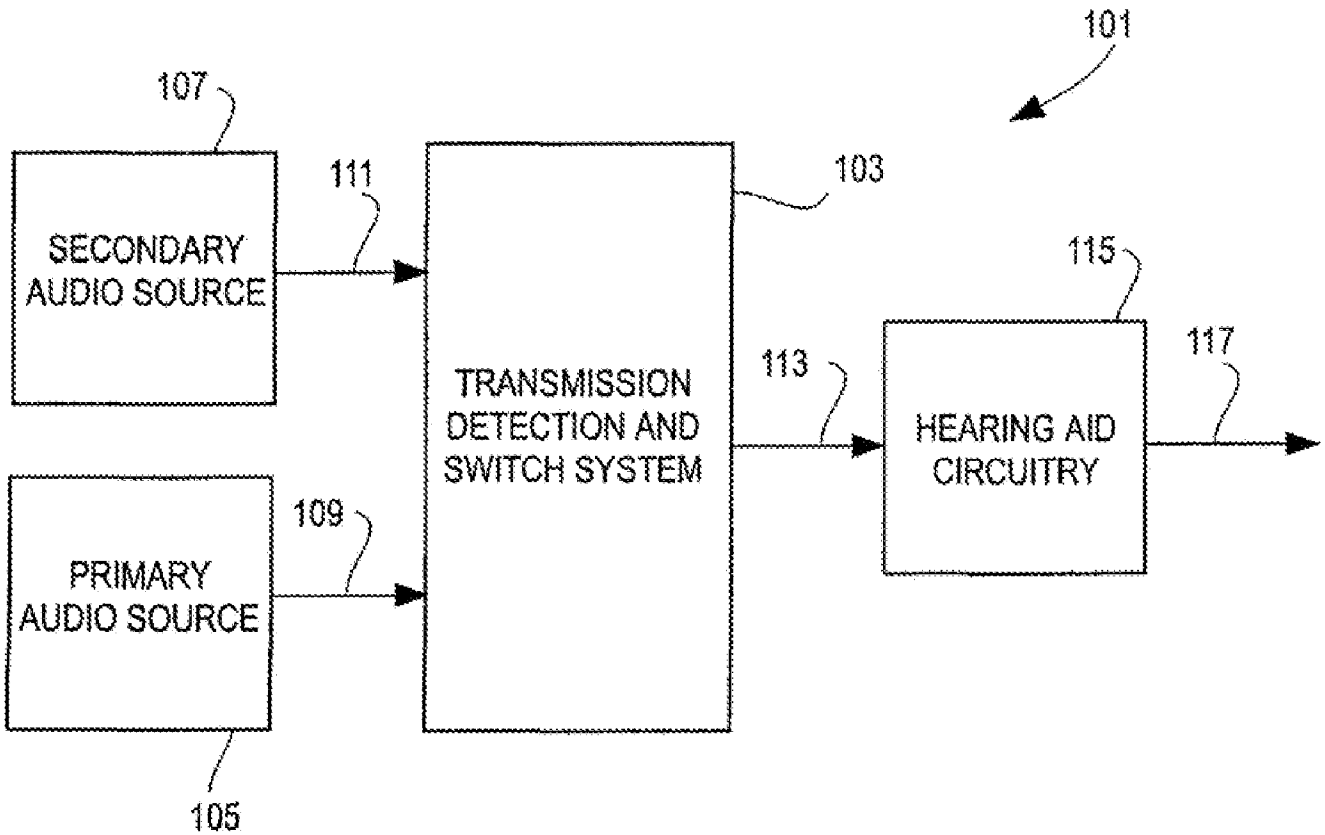
FIG. 1 is a block diagram of the overall hearing improvement system of the present invention.

FIG. 1 is a block diagram of an overall hearing improvement system 101 of the present invention. A transmission detection and switch system 103 receives signals from both a primary audio source 105 and a secondary audio source 107. The primary audio source 105 may be, for example, a directional or omnidirectional microphone located in a hearing aid. The secondary audio source 107 may be, for example, a directional microphone/transmitter mounted on eyeglasses (or otherwise supported by a hearing aid user), a television or stereo transmitter, a telephone or a microphone/transmitter combination under the control of a talker. In one embodiment, the secondary audio source 107 utilizes a wireless transmission scheme for transmission of signals to the transmission detection and switch system 103. In another embodiment, the secondary audio source 107 is wired to the transmission detection and switch system 103.

In operation, the transmission detection and switch system 103, which may or may not be located within the hearing aid, selects one of signals 109 and 111 (from the primary and secondary audio sources 105 and 107, respectively), and feeds the selected signal as an input 113 to hearing aid circuitry 115. Hearing aid circuitry 115, which may be, for example, a hearing aid amplifier and speaker, in turn generates an audio output 117 for transmission into the ear canal of the hearing aid user.

In one embodiment, when the secondary audio source 107 is selected for transmission into the ear canal of the hearing aid user, the primary audio source 105, i.e., the hearing aid microphone, is completely shut off. In this case, the hearing aid user cannot generally hear any audio received by the primary audio source 105. In another embodiment, however, even when the secondary audio source is selected, the primary audio source 105 is not completely shut off. Instead, the primary audio source 105 is only attenuated so that the hearing aid user can still hear background or room sounds when listening to the secondary audio source 107. Attenuation of the primary audio source 105 as such enables the hearing aid user to listen to the secondary audio source 107 while retaining a room sense or orientation that is provided to the hearing aid user by the primary audio source 105.

Figure 2:
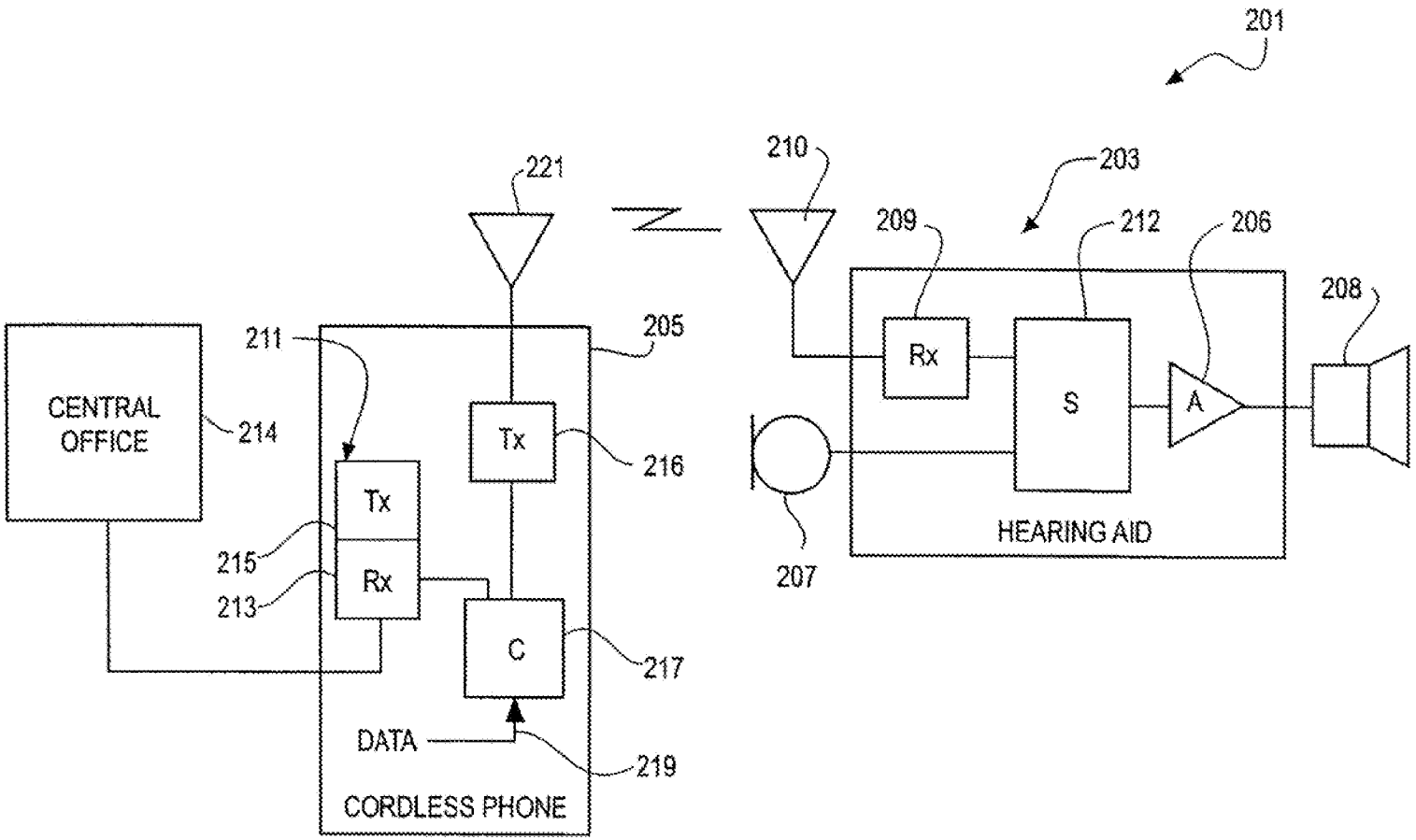
FIG. 2 is a block diagram of a more specific embodiment of an overall hearing improvement system in accordance with the present invention.

FIG. 2 is a block diagram of a more specific embodiment of an overall hearing improvement system in accordance with the present invention. The system 201 comprises a hearing aid 203, which may be one of several types of hearing aids currently available, such as, for example, the BTE, ITE, ITC and CIC hearing aids mentioned above. The hearing aid 203 comprises a housing that incorporates a microphone 207, which may either be a directional microphone, an omni-directional microphone, or a switchable combination of the two. In any case, the microphone 207 acts as a primary audio source for the hearing aid 203.

The hearing aid 203 also comprises a receiver 209 and associated circuitry for receiving wireless signals via an aerial 210. The receiver 209 and aerial 210 combination may be, for example, a radio frequency receiver and antenna or an inductive coil. The hearing aid 203 further comprises circuitry 212 that performs signal detecting, selecting and combining functionality. The circuitry 212 selects either signals received by the hearing aid microphone 207 or by the receiver 209, as discussed more completely herein. The selected signal (or combined signal, if applicable) is next fed to a hearing aid amplifier 206, which amplifies the selected signal, and then to a speaker 208, which converts the selected signal into audio and transmits the audio into the ear canal of a hearing aid user.

In addition to the hearing aid 203, the system 201 of FIG. 2 further comprises a telephone 205, which acts as a secondary audio source for the hearing aid 203. The telephone 205 is hard wired to a traditional telephone network for two-way voice communication via a central office 214. The telephone 205 comprises a typical transceiver 211 that has both a receiver 213 component for receiving voice audio signals from the central office 214 and a transmitter 215 component for transmitting voice audio signals to the central office 214.

The telephone 205 also comprises a second transmitter 216 and associated circuitry, as well as signal combiner circuitry 217 and a data input 219. The transmitter 216 is operatively coupled to the signal combiner circuitry 217, which in turn is operatively coupled to the receiver 213 and the data input 219. Data input 219 may receive data from, for example, a keyboard of the telephone 205 (not shown), memory within the telephone 205, an external computer or the like connected to the telephone 205, or from the central office 214. In any case, such data may be, for example, hearing aid programming information.

The combiner circuitry 217 of the telephone 205 transmits audio signals received by the receiver 213 and/or data signals received at the data input 219, to the transmitter 216. Signals received by the transmitter 216 from the combiner circuitry 217 are in turn transmitted wirelessly to the hearing aid 203 via an aerial 221. The transmitter 216 and aerial 221 combination may similarly be, for example, a radio frequency transmitter and antenna or an inductive coil.

In operation, the telephone 205 is brought into proximity of the ear of a hearing aid user. The circuitry 212 of the hearing aid 203 detects wireless signals being transmitted by the wireless transmission subsystem of the telephone 205. The hearing aid user then, if selection of the wireless signals is applicable, hears directly via the speaker 208 of the hearing aid 203 signals that would otherwise have been picked up via microphone 207 of the hearing aid 203 via a speaker of the telephone 205.

The wireless subsystem of the telephone 205 may be continuously activated, manually activated by a user, or may be automatically activated when the telephone 205 rings, is removed from the base unit, receives voice data, or senses that the telephone is in proximity of the hearing aid 203. In addition, the wireless subsystem of the telephone 205 may also assist the hearing aid user to hear the telephone ring. For example, the wireless scheme may broadcast a higher power signal that can be received by the receiver 209 of the hearing aid 203 for indicating to the wearer that the telephone 205 is ringing.

In any event, as is apparent from the above description, the telephone 205 of the system 201 of FIG. 2 essentially includes two communication subsystems that respectively communicate on two separate and distinct networks, namely the traditional hardwired telephone network and a low powered personal wireless network involving the hearing aid 203.

Figure 3:
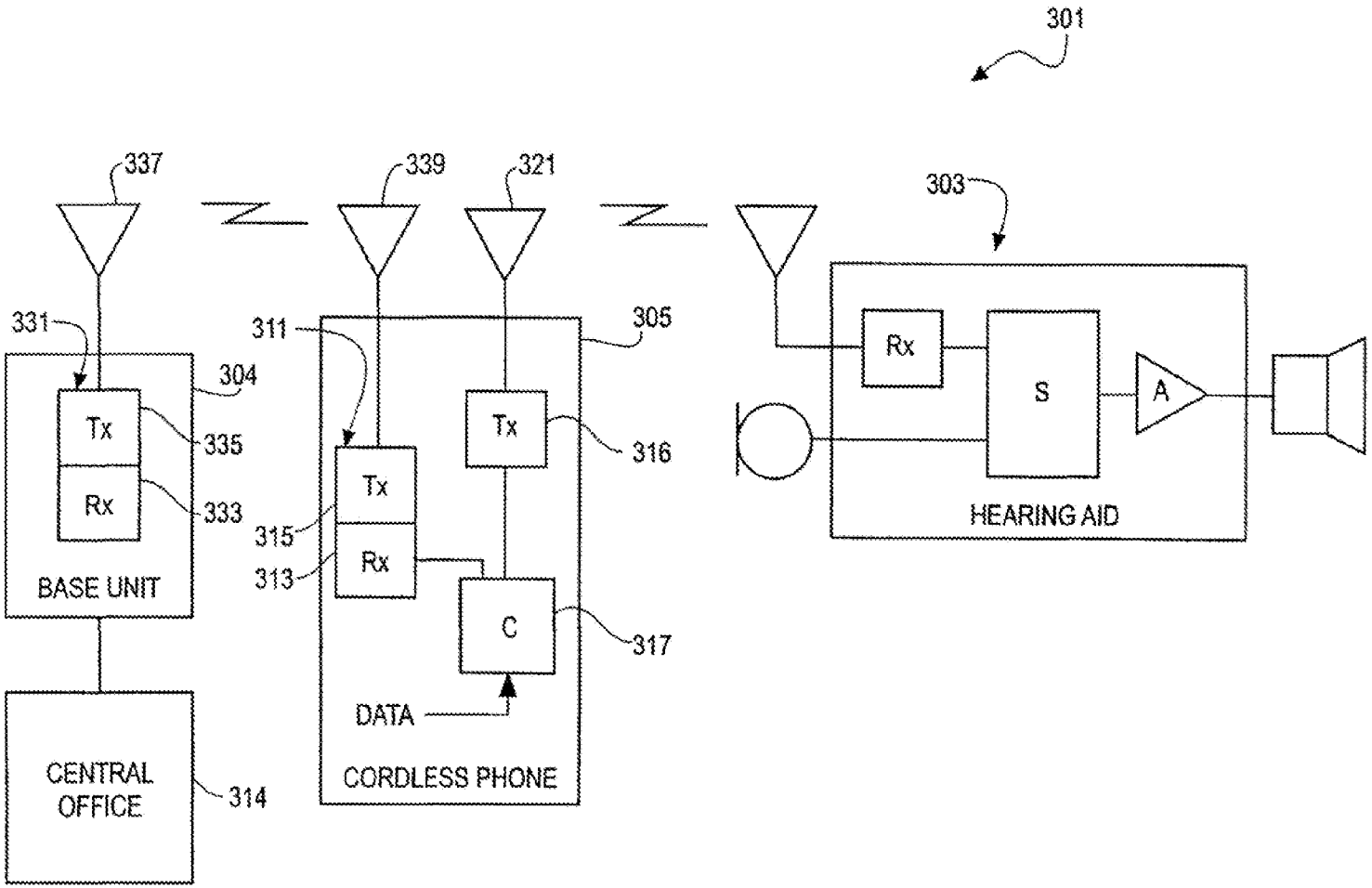
FIG. 3 is a block diagram of another more specific embodiment of an overall hearing improvement system in accordance with the present invention.

FIG. 3 is a block diagram of another more specific embodiment of an overall hearing improvement system in accordance with the present invention. The system 301 of FIG. 3 is similar to the system 201 of FIG. 2, in that hearing aid 303 of FIG. 3 may have the same components and functionality of the hearing aid 203 discussed above with respect to FIG. 2. However, in the system 301 of FIG. 3, the secondary audio source is different.

More specifically, the system 301 of FIG. 3 comprises a cordless telephone 305 rather than a corded telephone as found in FIG. 2. The cordless telephone 305 may have the same component(s) comprising the wireless subsystem for communication with the hearing aid as those found in the corded telephone in FIG. 2. Instead of being hardwired to a central office 314, however, the telephone 305 of FIG. 3 has a second wireless subsystem for communicating with a base unit 304, which itself is hardwired to the central office 314.

The base unit 304 comprises a wireless transceiver 331 that has a receiver 333 and a transmitter 335 component, as well as an aerial 337, which may be, for example, an antenna. The cordless telephone 305 similarly comprises a wireless transceiver 311 that has a receiver 313 component and a transmitter 315 component, as well as an aerial 339, which likewise may be, for example, an antenna. Signals received by the receiver 335 from the central office 314 are transmitted by the transmitter 335 via the aerial 337 to the cordless telephone 305. The receiver 313 of the cordless telephone 305 receives the signals via the aerial 339, which signals are then transmitted to signal combiner circuitry 317 of the cordless telephone 305. The signals are then transmitted via transmitter 316 and aerial 321 of the cordless telephone 305 to the hearing aid 303.

Similar to the telephone 205 of FIG. 2, the telephone 305 of FIG. 3 essentially includes two communication subsystems that respectively communicate on two separate and distinct networks. This time, however, the communication subsystems are both (at least partially) wireless. The telephone 305 communicates on two personal wireless networks, namely a higher powered one within a home or other premises (which in turn is hardwired to the main telephone network), and a lower powered one involving the hearing aid 303. In all other respects, however, the telephone 305 may have the same functionality as that discussed above with respect to telephone 205 of FIG. 2.

Figure 4:
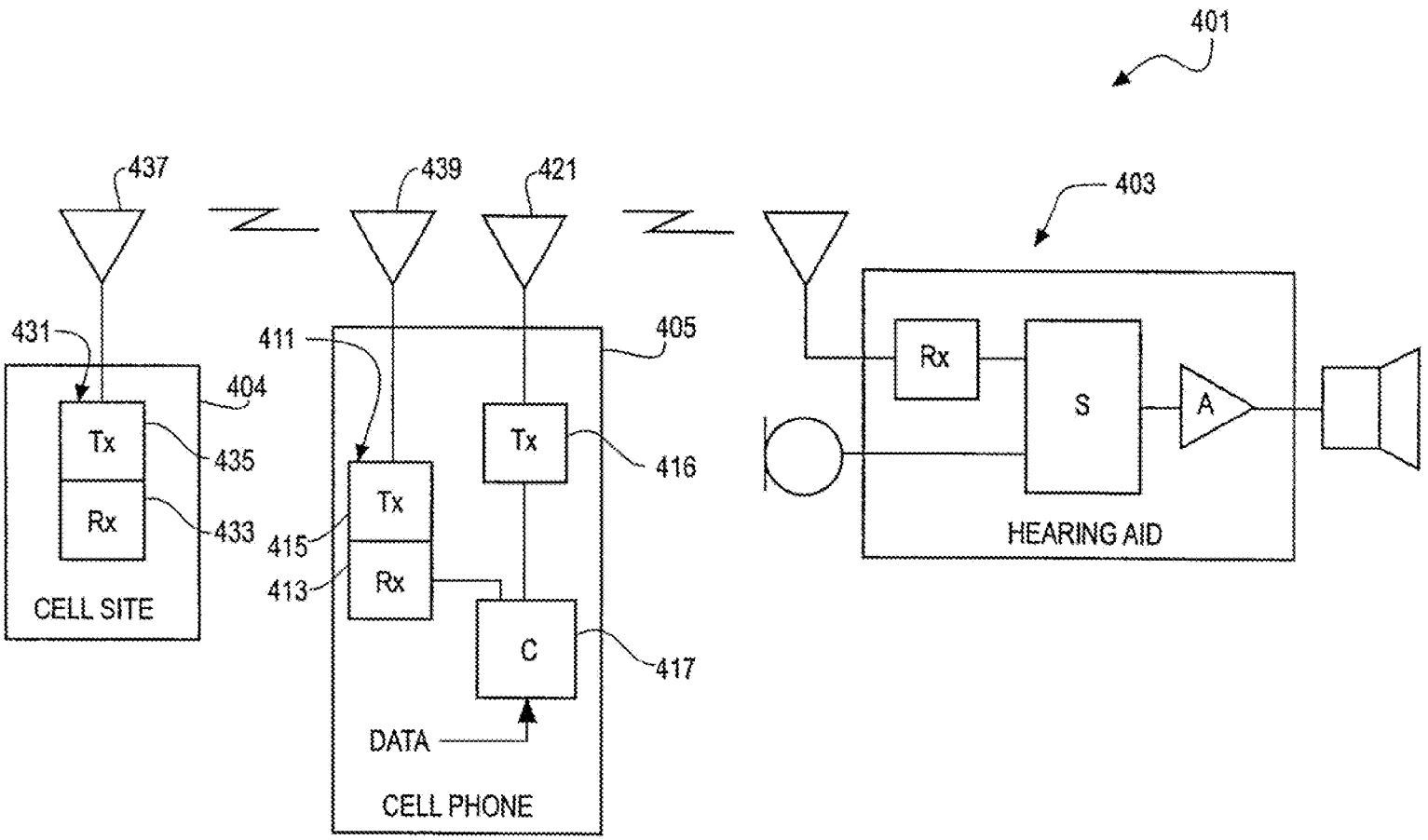
FIG. 4 is a block diagram of a further more specific embodiment of an overall hearing improvement system in accordance with the present invention.

FIG. 4 is a block diagram of a further more specific embodiment of an overall hearing improvement system in accordance with the present invention. The system 401 of FIG. 4 is similar to the system 301 of FIG. 3, in that hearing aid 403 of FIG. 4 may have the same components and functionality of the hearing aid 203 discussed above with respect to FIG. 2. Again, however, in the system 401 of FIG. 4, the secondary audio source is different.

More specifically, in FIG. 4, the secondary audio source is a cellular telephone 405. Like the cordless telephone in FIG. 3, the cellular telephone 405 may have the same component(s) comprising the wireless subsystem for communication with the hearing aid as those found in the corded telephone in FIG. 2. Instead of wirelessly communicating with a base unit that is hardwired to a central office, however, the cellular telephone 405 communicates with a cell site 404 on a wide area cellular network.

The cell site 404 comprises a wireless transceiver 431 that has a receiver 433 and a transmitter 435 component, as well as an aerial 437, which may be, for example, an antenna. The cellular telephone 405 similarly comprises a wireless transceiver 411 that has a receiver 413 component and a transmitter 415 component, as well as an aerial 439, which likewise may be, for example, an antenna. Signals received via the wide area cellular network by the receiver 435 of the cell site 404 are transmitted by the transmitter 435 via the aerial 437 to the cellular telephone 405. The receiver 413 of the cellular telephone 405 receives the signals via the aerial 439, which signals are then transmitted to signal combiner circuitry 417 of the cellular telephone 405. The signals are then transmitted via transmitter 416 and aerial 421 of the cellular telephone 405 to the hearing aid 403.

Similar to the telephones 205 and 305 of FIGS. 2 and 3, respectively, the telephone 405 of FIG. 4 essentially includes two communication subsystems that respectively communicate on two separate and distinct networks. This time, however, the communication subsystems are both entirely wireless. The cellular telephone 405 not only communicates on a high-powered wide area cellular network, but also a lower powered one involving the hearing aid 403. In all other respects, however, the telephone 405 may have the same functionality as that discussed above with respect to telephone 205 of FIG. 2.

Figure 5:
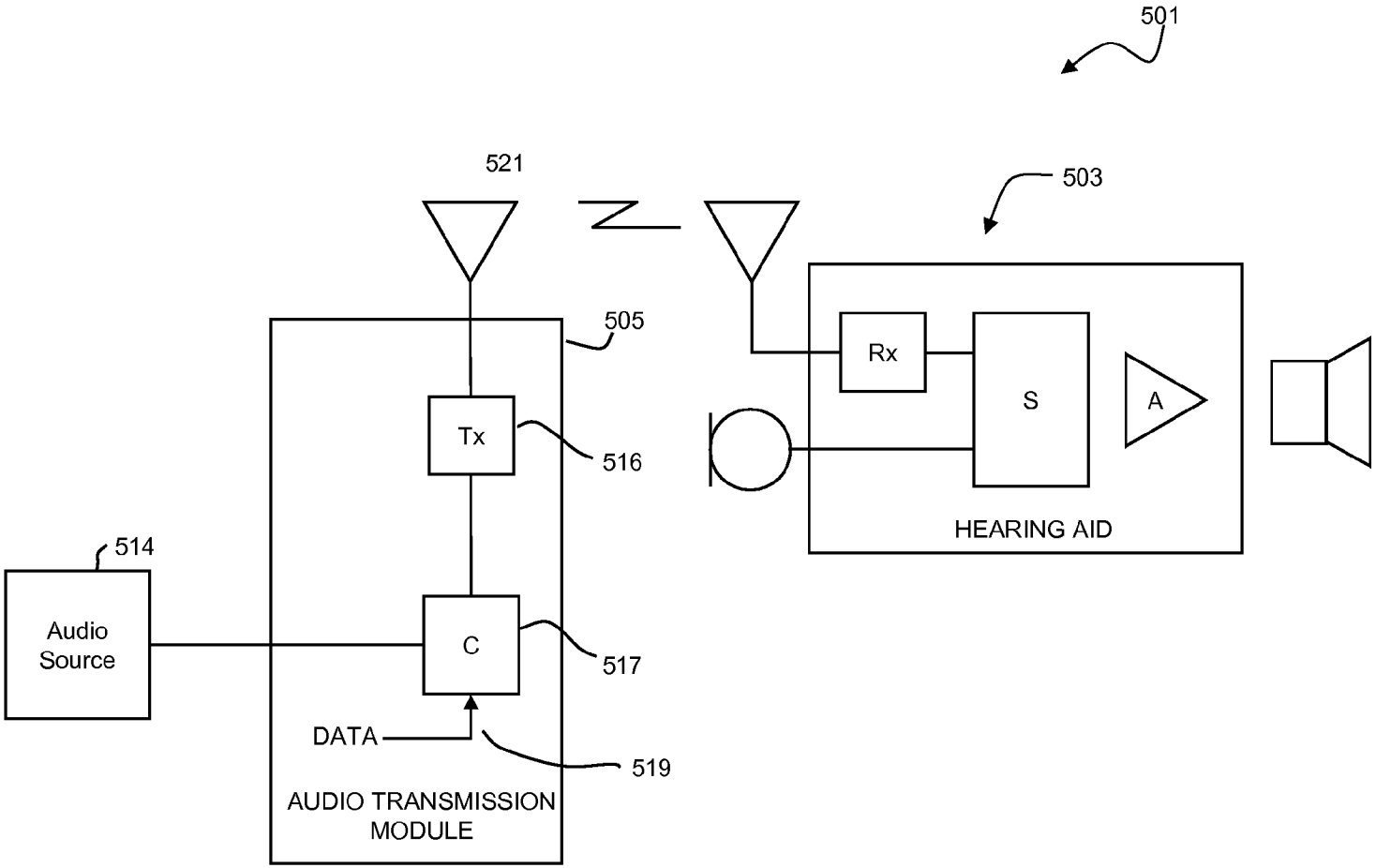
FIG. 5 is a block diagram of a still further more specific embodiment of an overall hearing improvement system in accordance with the present invention.

FIG. 5 is a block diagram of a still further more specific embodiment of an overall hearing improvement system in accordance with the present invention. The system 501 of FIG. 5 is similar to the systems 301 of FIG. 3 and 401 of FIG. 4, in that hearing aid 503 of FIG. 5 may have the same components and functionality of the hearing aid 203 discussed above with respect to FIG. 2. In the system 501 of FIG. 5, however, the secondary audio source is different altogether.

More specifically, the secondary audio source of FIG. 5 is an audio transmission module 505. The audio transmission module comprises signal combiner circuitry 517 that is hardwired to an audio source 514. The audio source 514 may be, for example, a stereo or other home entertainment system, movie audio at a movie theatre, car audio, etc. The combiner circuitry 517 of the module 505 transmits audio signals received by the receiver from the audio source 514 and/or data signals received at the data input 519, to the transmitter 516. Signals received by the transmitter 516 from the combiner circuitry 517 are in turn transmitted wirelessly to the hearing aid 503 via an aerial 521. The transmitter 516 and aerial 521 combination may be, for example, a radio frequency transmitter and antenna or an inductive coil.

The audio transmission module 505 may, for example, be located in the seat back of a chair proximate the head position of a person sitting in the chair or in a head-rest of a chair. In operation, the hearing aid user brings the user's ear into proximity of the transmission module 505. The circuitry of the hearing aid 503 detects wireless signals being transmitted by the audio transmission module 505. The hearing aid user then, if selection of the wireless signals is applicable, hears directly from the audio source 514 signals that would otherwise have been picked up via microphone of the hearing aid 503 from audio in the listening room.

The wireless subsystem of the audio transmission module 505 may be continuously activated, manually activated by a user, or may be automatically activated when the module 505 receives audio data or senses that the hearing aid 503 has been brought in proximity of the module 505.

Figure 6:
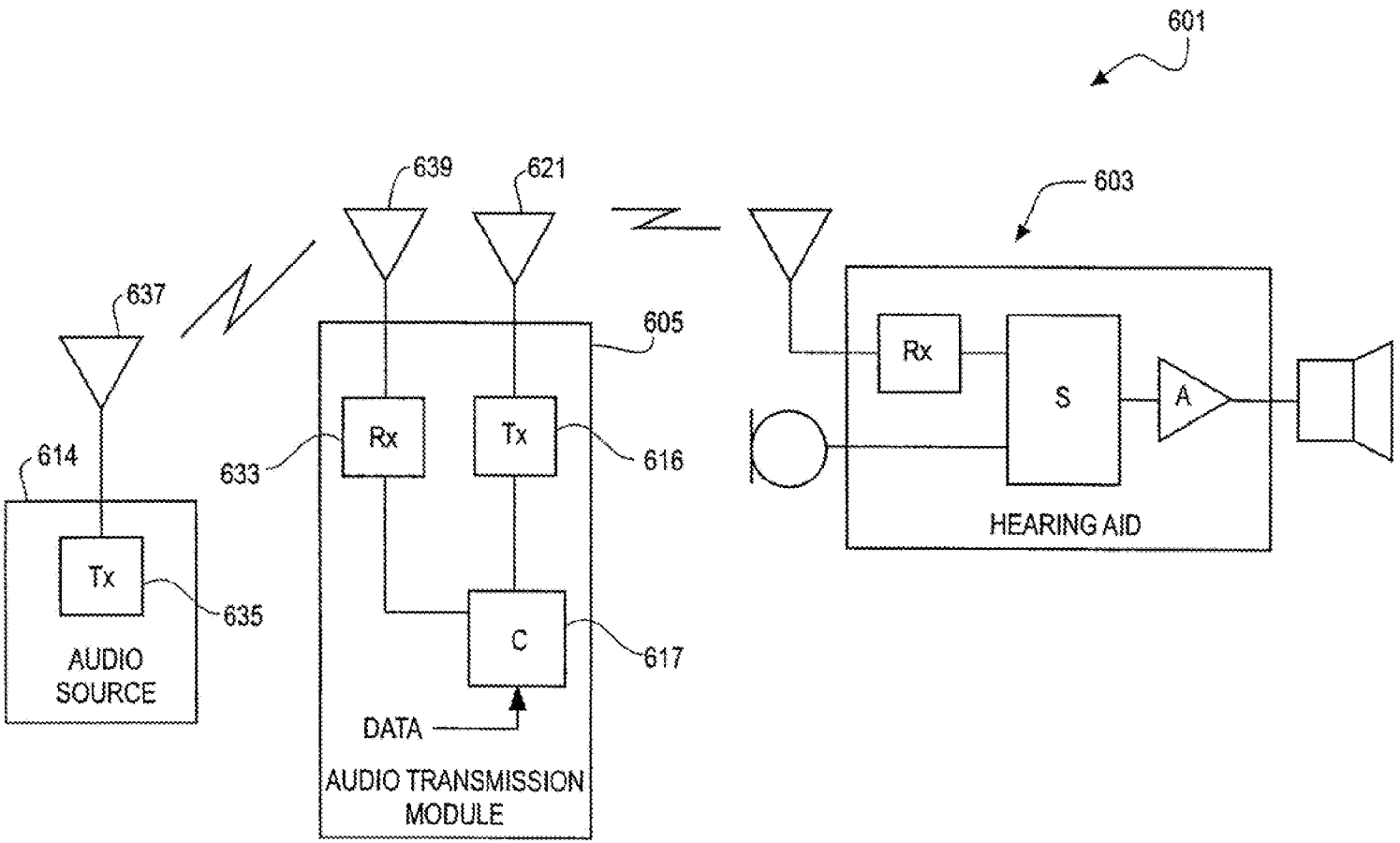
FIG. 6 is a block diagram of yet another more specific embodiment of an overall hearing improvement system in accordance with the present invention.

FIG. 6 is a block diagram of yet another more specific embodiment of an overall hearing improvement system in accordance with the present invention. The system 601 of FIG. 6 is similar to the system 501 of FIG. 5, in that hearing aid 603 of FIG. 6 may have the same components and functionality of the hearing aid 203 discussed above with respect to FIG. 2. In addition, the secondary audio source of FIG. 6 is an audio transmission module 605, similar to audio transmission module 505 of FIG. 5. This time, however, the audio transmission module 605 is not hard wired to the audio source. Instead, communication between the audio source 614 and audio transmission module 605 is wireless.

The audio transmission module 605 may have the same component(s) comprising the wireless subsystem for communication with the hearing aid as those found in the audio transmission module 505 of FIG. 5. The audio transmission module 605, however, further comprises a receiver 633 component and an aerial 639, which may be, for example, an antenna, for wirelessly receiving audio signals from the audio source 614. The audio source 614 comprises a transmitter 635 and an aerial 637, which similarly may be, for example, an antenna.

In operation, the audio source 614 transmits audio signals via the aerial 637 to the audio transmission module 605. Signals received by the receiver 633 of the audio transmission module 605 from the audio source 614 are transmitted to combiner circuitry 617, which in turn forwards the audio signals to the transmitter 616. Those signals are in turn transmitted wirelessly to the hearing aid 603 via the aerial 621. Again, the transmitter 616 and aerial 621 combination may be, for example, a radio frequency transmitter and antenna or an inductive coil.

Because the audio transmission module 605 is wireless (and thus need not be wired to the audio source 614), the audio transmission module 605 may be located just about anywhere in a room or premises that is within range of the audio source 614. In addition, the audio transmission module 605, like the cordless telephone of FIG. 3, operates on two separate personal wireless networks, a higher powered one involving the audio source 614 and a lower powered one involving the hearing aid 603. Aside from its wireless receipt of signals from the audio source 614, however, the audio transmission module 605 may operate in the same manner as the audio transmission module 505 of FIG. 5.

Figure 7:
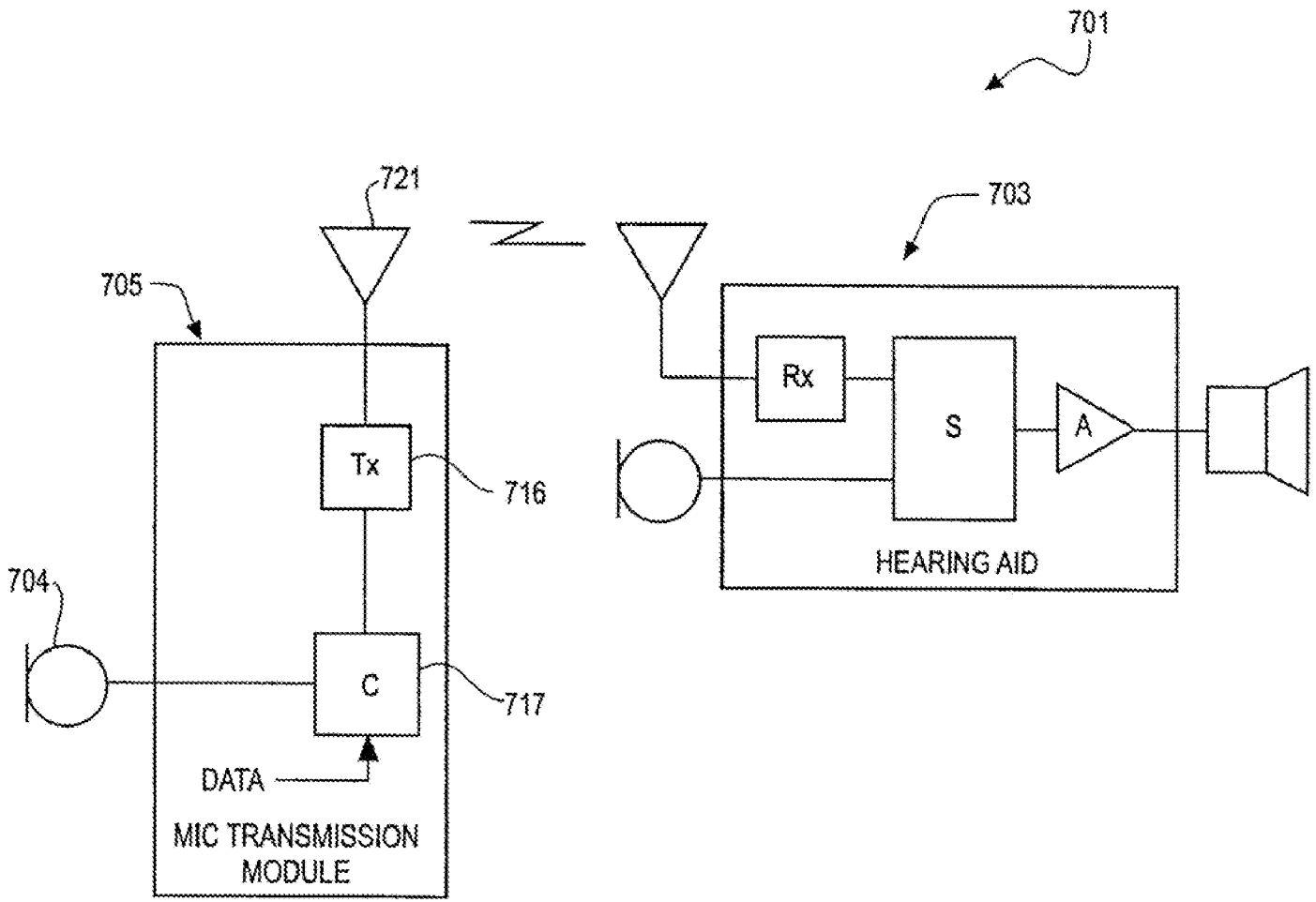
FIG. 7 is a block diagram of still another more specific embodiment of an overall hearing improvement system in accordance with the present invention.

FIG. 7 is a block diagram of still another more specific embodiment of an overall hearing improvement system in accordance with the present invention. The system 701 of FIG. 7 is similar to those discussed above, in that hearing aid 703 of FIG. 7 may have the same components and functionality of the hearing aid 203 discussed above with respect to FIG. 2. In addition, the secondary audio source of FIG. 7 is an audio transmission module similar to audio transmission modules 505 and 605 of FIGS. 5 and 6, respectively. In FIG. 7, however, the audio transmission module is a microphone transmission module 705. Instead of receiving audio signals from an audio source, such as a home entertainment system, the microphone transmission module 705 picks up sound from a microphone 704 that is distinct from the microphone of the hearing aid 703. In all other respects, the audio transmission module 705 may operate in the same manner as, and be positioned in the same environments as, the audio transmission module 505 of FIG. 5.

The microphone 704 of the microphone transmission module 705 may be, for example, a directional microphone array or other directional microphone. The microphone transmission module 705 may be worn or otherwise supported by the hearing aid user, or even a talker if the talker is within range for wireless transmission between the microphone transmission module 705 and the hearing aid 703. The microphone transmission module 705 may have the same component(s) comprising the wireless subsystem for communication with the hearing aid as those found in the audio transmission module 505 of FIG. 5. In addition, the microphone transmission module 705 may be continuously activated, manually activated by a user, or may be automatically activated when the module 705 receives audio transmissions or senses that the hearing aid 703 has been brought in proximity of the module 705 (or vice versa).

In operation, the microphone 704 picks up audio and converts it into audio signals. The signals are then transmitted to combiner circuitry 717, which in turn forwards the audio signals to the transmitter 716. Those signals are in turn transmitted wirelessly to the hearing aid 703 via the aerial 721. As previously, the transmitter 716 and aerial 721 combination may be, for example, a radio frequency transmitter and antenna or an inductive coil.

Figure 8:
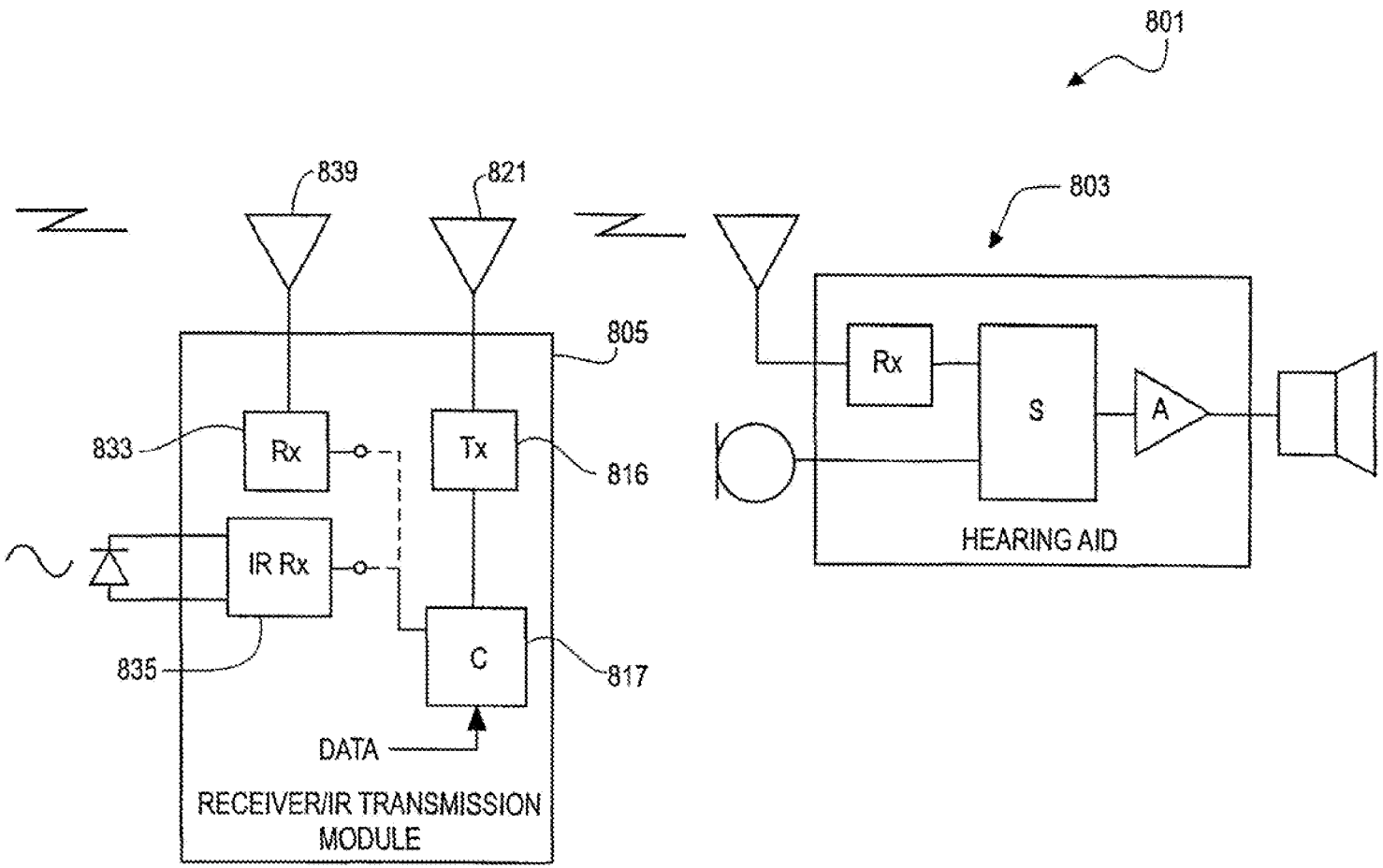
FIG. 8 is a block diagram of a further more specific embodiment of an overall hearing improvement system in accordance with the present invention.

FIG. 8 is a block diagram of a further more specific embodiment of an overall hearing improvement system in accordance with the present invention. The system 801 of FIG. 8 is similar to the system 701 of FIG. 7. In FIG. 8, however, the transmission module 805 receives wireless audio signals from an external audio source, which may be any type of audio source including a "remote" microphone. The transmission module 805 may have the same component(s) comprising the wireless subsystem for communication with the hearing aid as those found in the audio transmission module 505 of FIG. 5. In addition, the audio transmission module 805 may generally operate in the same manner as the audio transmission module 505 of FIG. 5.

The transmission module 805 further comprises a receiver 833 component and/or an infrared receiver 835 component. The transmission module 805 may receive audio signals via the receiver 833 and the aerial 839, which may be, for example, an antenna. Alternatively, the transmission module 805 may receive infrared audio signals via the infrared receiver 835. The signals are then transmitted to combiner circuitry 817, which in turn forwards the audio signals to the transmitter 816. Those signals are in turn transmitted wirelessly to the hearing aid 803 via the aerial 821. As with other embodiments, the transmitter 816 and aerial 821 combination may be, for example, a radio frequency transmitter and antenna or an inductive coil.

Figure 9:
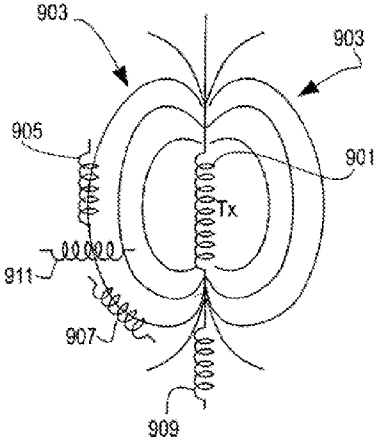
FIG. 9 illustrates a component orientation guideline for wireless communication between a secondary audio source and a hearing aid in accordance with the present invention.

FIG. 9 illustrates a component orientation guideline for wireless communication between a secondary audio source and a hearing aid in accordance with the present invention. FIG. 9 specifically illustrates a guideline for the case of inductive wireless transmission. A transmitting coil 901 is shown surrounded by a magnetic field 903. Location of the receiving coil at positions 905 and 909 relative to transmitting coil 901 are advantageous. Locations such as position 907 generally aligned with the magnetic field 903 are also acceptable. Locations such as position 911 aligned perpendicularly to the magnetic field should be avoided, however, due to the null located at such positions.

Figure 9A:
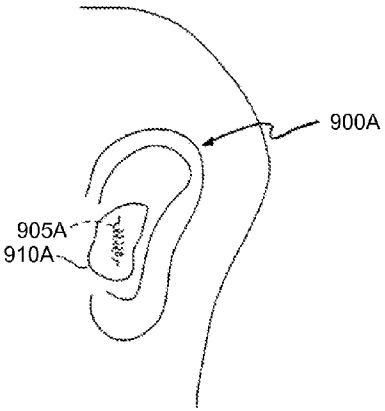
FIG. 9A shows a side view of the head of a user wearing an in-the-ear (ITE) type of hearing aid.

FIG. 9A shows a side view of the head of a user wearing an in-the-ear (ITE) type of hearing aid 910A. ITE hearing aid 910A contains telecoil 905A, which in the illustration is shown in a vertical orientation. Other orientations of telecoil 910A within ITE hearing aid 910A are possible, however a vertical orientation is most frequently used for compatibility with room loop systems and neck loops, while maintaining adequate compatibility with telephone receivers. As discussed above with respect to FIG. 9, the orientation of telecoil 905A makes it most sensitive to vertically oriented lines of magnetic flux, such as those generated by coil 901 of FIG. 9.

Figure 9B:
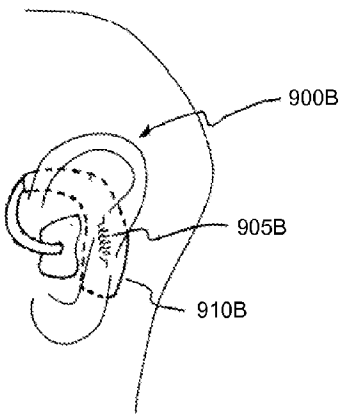
FIG. 9B illustrates a side view of the head of a user wearing a behind-the-ear (BTE) type of hearing aid.

FIG. 9B illustrates a side view of the head of a user wearing a behind-the-ear (BTE) type of hearing aid 910B. This type of hearing aid is positioned behind the curve of the outer ear, between the outer ear and the head. BTE hearing aid 910B as shown is equipped with telecoil 905B. The primarily vertical orientation of BTE hearing aid 910B permits telecoil 905B to be vertically oriented and of greater length and sensitivity than that in the ITE hearing aid of FIG. 9A. As with the ITE hearing aid 910A shown in FIG. 9A, the orientation of telecoil 905B makes it most sensitive to those magnetic fields whose flux lines are primarily vertical, such as the lines of flux created by coil 901 of FIG. 9. There is significant variation, though, among the many commercially available hearing aids in positioning of telecoil 905B along the length of the body.

Figure 10:
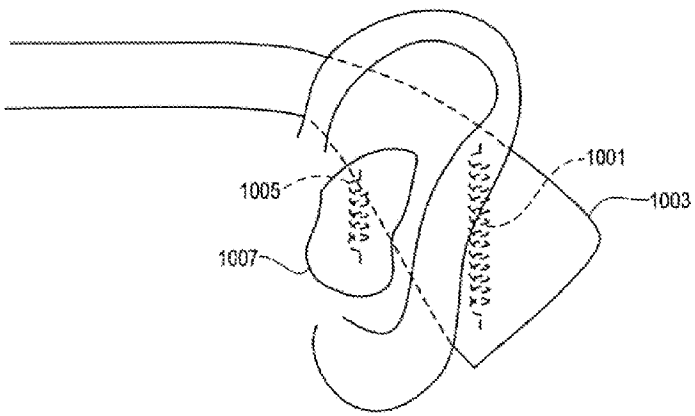
FIG. 10 illustrates an advantageous positioning of a transmitting coil relative to a receiving coil based on the guidelines of FIG. 9.

FIG. 10 illustrates an advantageous positioning of a transmitting coil relative to a receiving coil based on the guidelines of FIG. 9. Transmitting coil 1001, located in or on a glasses frame 1003, is positioned parallel and to the side of a receiving coil 1005 located within a hearing aid 1007.

Figure 11:
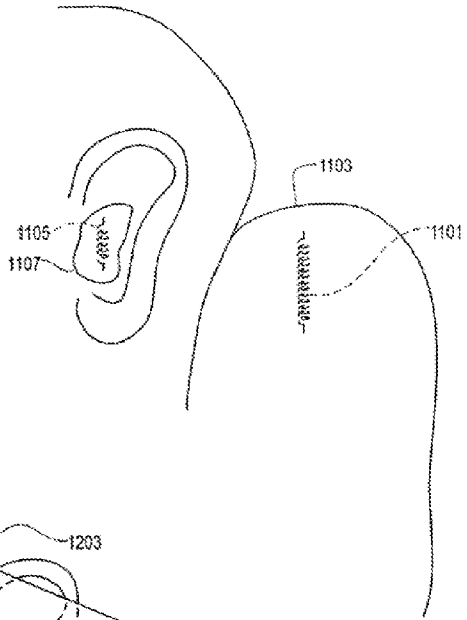
FIG. 11 illustrates an advantageous positioning of a transmitting coil relative to a receiving coil in another embodiment based on the guidelines of FIG. 9.

FIG. 11 illustrates an advantageous positioning of a transmitting coil relative to a receiving coil in another embodiment based on the guidelines of FIG. 9. Transmitting coil 1101, located in seat back or headrest 1103, is similarly positioned parallel and to the side of a receiving coil 1105 located within a hearing aid 1107 when the hearing aid user is in a seated position. This relative positioning will be generally maintained with normal left-right head movements.

Figure 12:
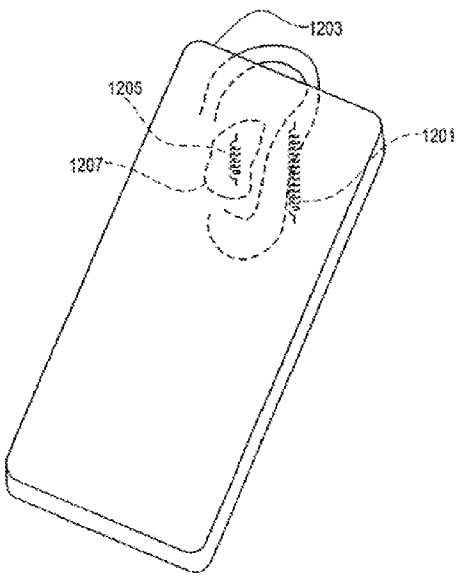
FIG. 12 illustrates an advantageous positioning of a transmitting coil relative to a receiving coil in yet another embodiment based on the guidelines of FIG. 9.

FIG. 12 illustrates an advantageous positioning of a transmitting coil relative to a receiving coil in yet another embodiment based on the guidelines of FIG. 9. Transmitting coil 1201, located in telephone 1203, is again similarly positioned parallel and to the side of a receiving coil 1205 located within a hearing aid 1207 when the phone is located proximate the ear in a typical manner.

Figure 13:
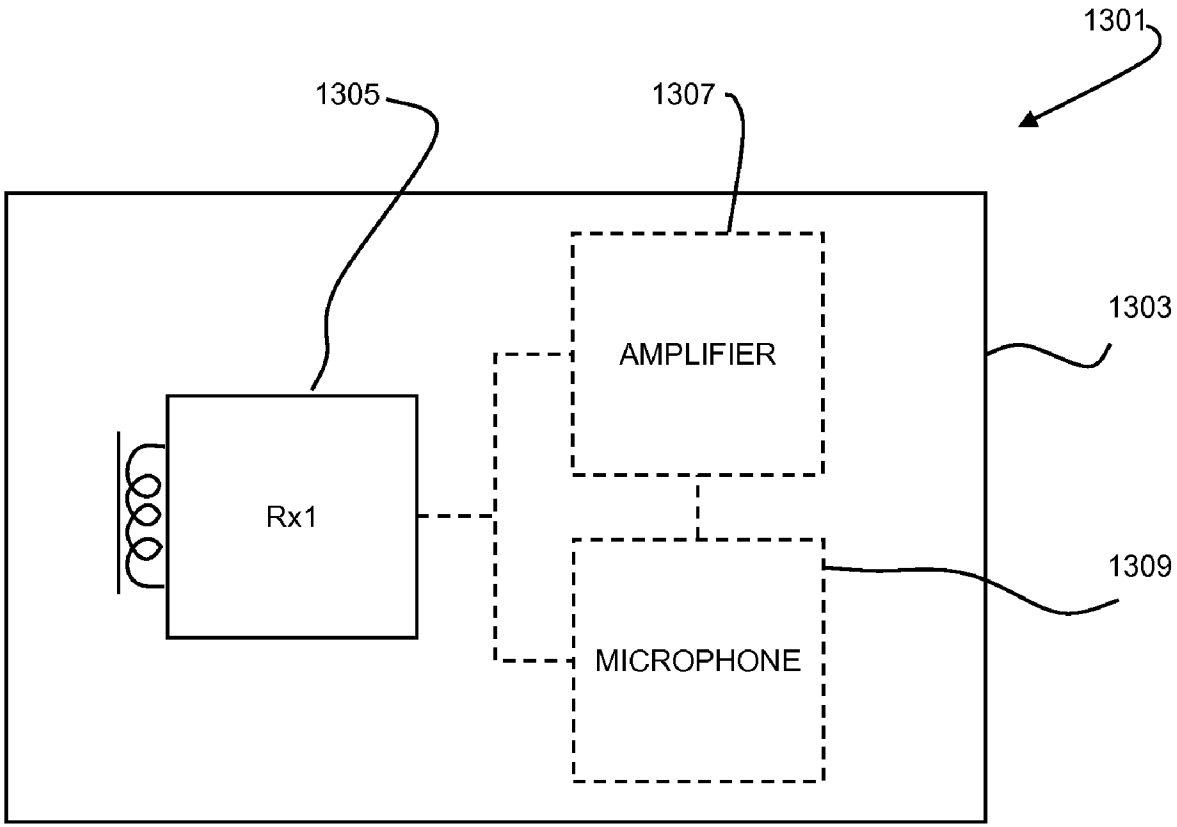
FIG. 13 illustrates a block diagram of a module for incorporation with a hearing aid.

Certain components used by the hearing improvement system of the present invention may be integrated into a single module that may be manufactured/assembled separately and simply incorporated into or with the hearing aids or secondary audio sources contemplated by the present invention. For example, FIG. 13 illustrates a block diagram of such a module for incorporation with a hearing aid. Module 1301 comprises a hearing aid faceplate 1303 that incorporates a receiver component 1305 having an inductive coil. The faceplate 1303 may also incorporate a hearing aid amplifier 1307 and/or a hearing aid microphone 1309 operatively coupled to the receiving component 1305. The module 1301 may be pre-assembled and sold as a unit to hearing aid manufacturers or sellers who simply install the faceplate 1303 onto a hearing aid shell, and connect the appropriate components. Alternatively, the components 1305, 1307 and 1309 may be integrated into a module that does not include the faceplate 1303 such as, for example, for use with BTE type hearing aids or other types of listening devices.

Figure 14A:
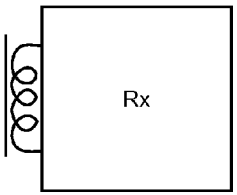
FIGS. 14A, 14B and 14C illustrate block diagrams for different potential modules for insertion into or incorporation with a hearing aid.
Figure 14B:
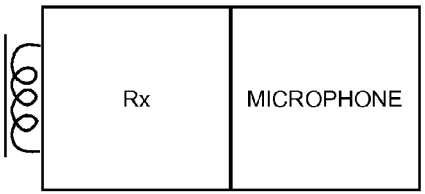
Figure 14C:
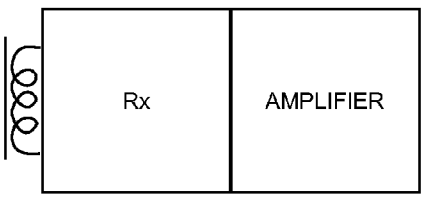

FIGS. 14A, 14B and 14C illustrate block diagrams for different potential modules for insertion into or incorporation with a hearing aid. FIG. 14A shows a module that is simply comprised of a receiver component having an inductive coil or other type of antenna. FIG. 14B shows a module that likewise has a receiver component having an inductive coil (or other type of antenna), as well as an integrated microphone component. FIG. 14C shows a module that likewise has a receiver component having an inductive coil (or other type of antenna), as well as an integrated amplifier component.

Like the module(s) of FIG. 13, the modules of FIG. 14 may be pre-assembled and sold as a unit to hearing aid or other manufacturers or sellers who simply install the module into the hearing aid or other device and connect the appropriate components.

Figure 15A:
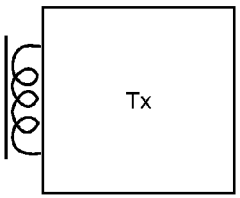
FIGS. 15A, 15B and 15C illustrate block diagrams for different potential modules for insertion into or incorporation with a secondary audio source.
Figure 15B:
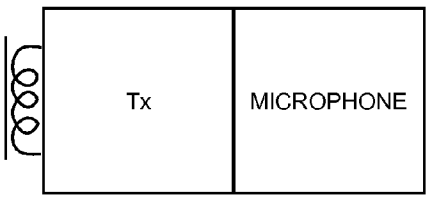
Figure 15C:
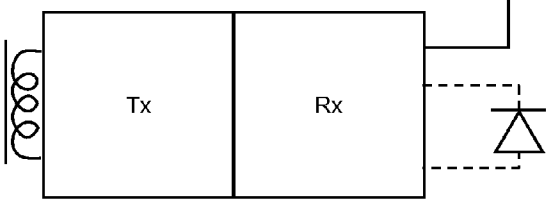

FIGS. 15A, 15B and 15C illustrate block diagrams for different potential modules for insertion into or incorporation with a secondary audio source. FIG. 15A shows a module that is simply comprised of a transmitter component having an inductive coil or other type of antenna. FIG. 15B shows a module that likewise has a transmitter component having an inductive coil (or other type of antenna), as well as an integrated microphone component. FIG. 15C shows a module that has a receiver component, in addition to a transmitter component having an inductive coil (or other type of antenna). These modules may be pre-assembled and sold as a unit to manufacturers or sellers of secondary audio sources who simply install the module into the secondary audio source and connect the appropriate components.

Figure 16:
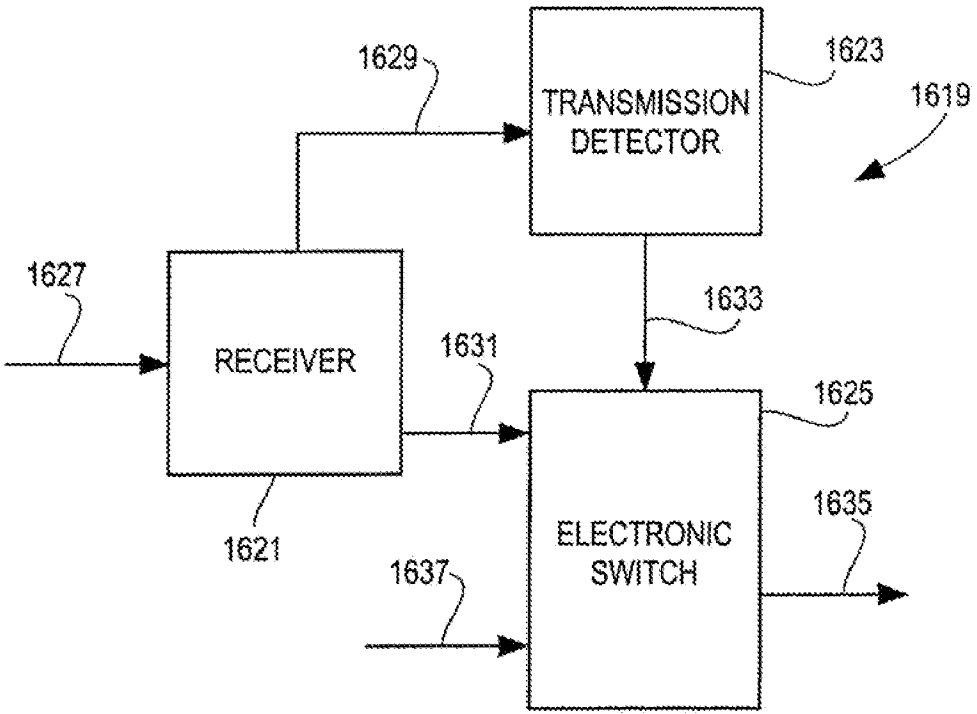
FIG. 16 is a block diagram of one embodiment of a transmission detection and switch system of the present invention.

FIG. 16 is a block diagram of one embodiment of the transmission detection and switch system of the present invention. A transmission detection and switch system 1619, may comprise three basic components, a receiver 1621, a transmission detector 1623 and an electronic switch 1625. The receiver 1621 receives an input signal 1627 from a secondary audio source (not shown). Upon receipt of the input signal 1627 the receiver 1621 generates a detector input signal 1629, as well as an audio output signal 1631 representative of the input signal 1627. The transmission detector 1623 receives the detector input signal 1629, and generates in response a control signal 1633 for the electronic switch 1625. The electronic switch 1625 is controlled by the status of the control signal 1633.

More specifically, for example, if the transmission detector 1623 determines from the detector input signal 1629 that the input signal 1627 represents a desired transmission (e.g., a signal above a certain threshold value), the detector 1623 indicates to the electronic switch 1625, using control signal 1633, that a signal is present. The electronic switch 1625 in turn selects audio output 1631 (representative of the input signal 1627 from the secondary audio source) and provides the audio output 1631 as signal 1635 to hearing aid or other type of circuitry (not shown).

If, on the other hand, the transmission detector 1623 determines from the detector input signal 1629 that the input signal 1629 is not representative of a desired signal (e.g., below a certain threshold value), the detector 1623 indicates to the electronic switch 1625, again using control signal 1633, that no signal is present. The switch then instead selects audio output signal 1637 from the primary audio source (e.g., a hearing aid microphone), and provides the audio output signal 1637 as signal 1635 to the hearing aid or other type of circuitry (not shown).

Figure 17:
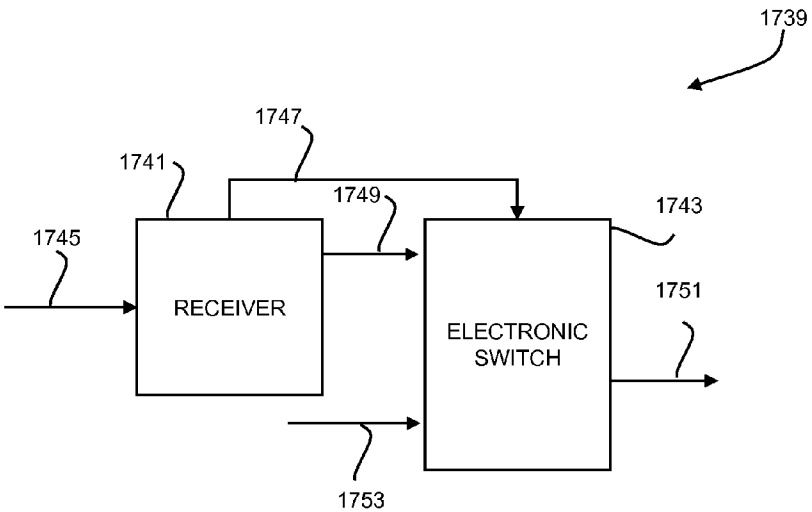
FIG. 17 is a block diagram of another embodiment of a transmission detection and switch system of the present invention.

FIG. 17 is a block diagram of another embodiment of the transmission detection and switch system of the present invention. A transmission detection and switch system 1739 may comprise a receiver 1741 and an electronic switch 1743. The receiver 1741 receives an input signal 1745 from a secondary audio source (not shown). If the input signal 1745 is a desired signal, then receiver 1741 generates a control signal 1747 for the electronic switch 1743. If the input signal 1745 is not a desired signal, then no control signal is generated by the receiver 1741. In either case, the desirability of the signal may be determined by, for example, the receiver 1741 or circuitry associated therewith.

If the electronic switch 1743 receives the control signal 1747 from the receiver 1741, the electronic switch selects receiver output signal 1749, which is an audio output signal representative of input signal 1745 from the secondary audio source (not shown), and provides receiver output signal 1749 as signal 1751 to hearing aid circuitry (not shown).

If, on the other hand, the electronic switch 1743 does not receive the control signal 1747 from the receiver 1741, then the electronic switch selects audio output signal 1753 from the primary audio source (e.g., a hearing aid microphone), and provides the audio output signal 1753 as signal 1751 to the hearing aid circuitry (not shown).

Figure 18:
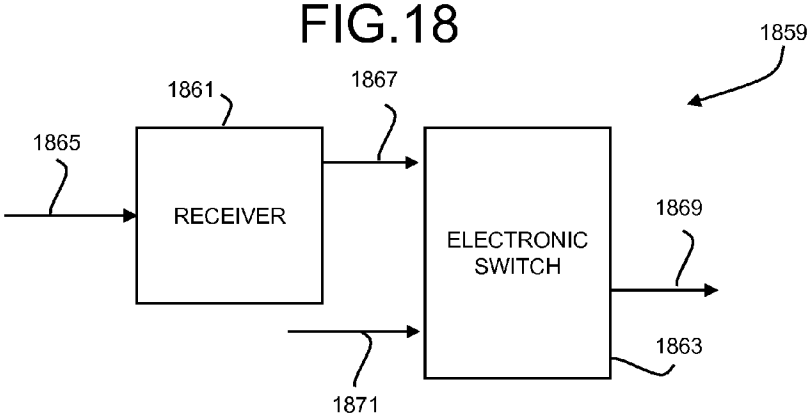
FIG. 18 is a block diagram of a further embodiment of a transmission detection and switch system of the present invention.

FIG. 18 is a block diagram of a further embodiment of the transmission detection and switch system of the present invention. A transmission detection and switch system 1859 may comprise a receiver 1861 and an electronic switch 1863. The receiver 1861 receives an input signal 1865 from a secondary audio source (not shown), and generates an audio output signal 1867 representative of the input signal 1865 for transmission to electronic switch 1863. The electronic switch 1863 receives the audio output signal 1867, and, if it is determined that the audio output signal 1867 is a desired signal, the electronic switch 1863 provides the audio output signal 1867 as signal 1869 to hearing aid circuitry (not shown). If, on the other hand, it is determined that the audio output signal 1867 is not a desired signal, the electronic switch 1863 provides audio output signal 1871 as signal 1869 to the hearing aid circuitry (not shown). In either case, the desirability of the signal 1867 may be determined by the electronic switch 1863 or circuitry associated therewith.

Figure 19:
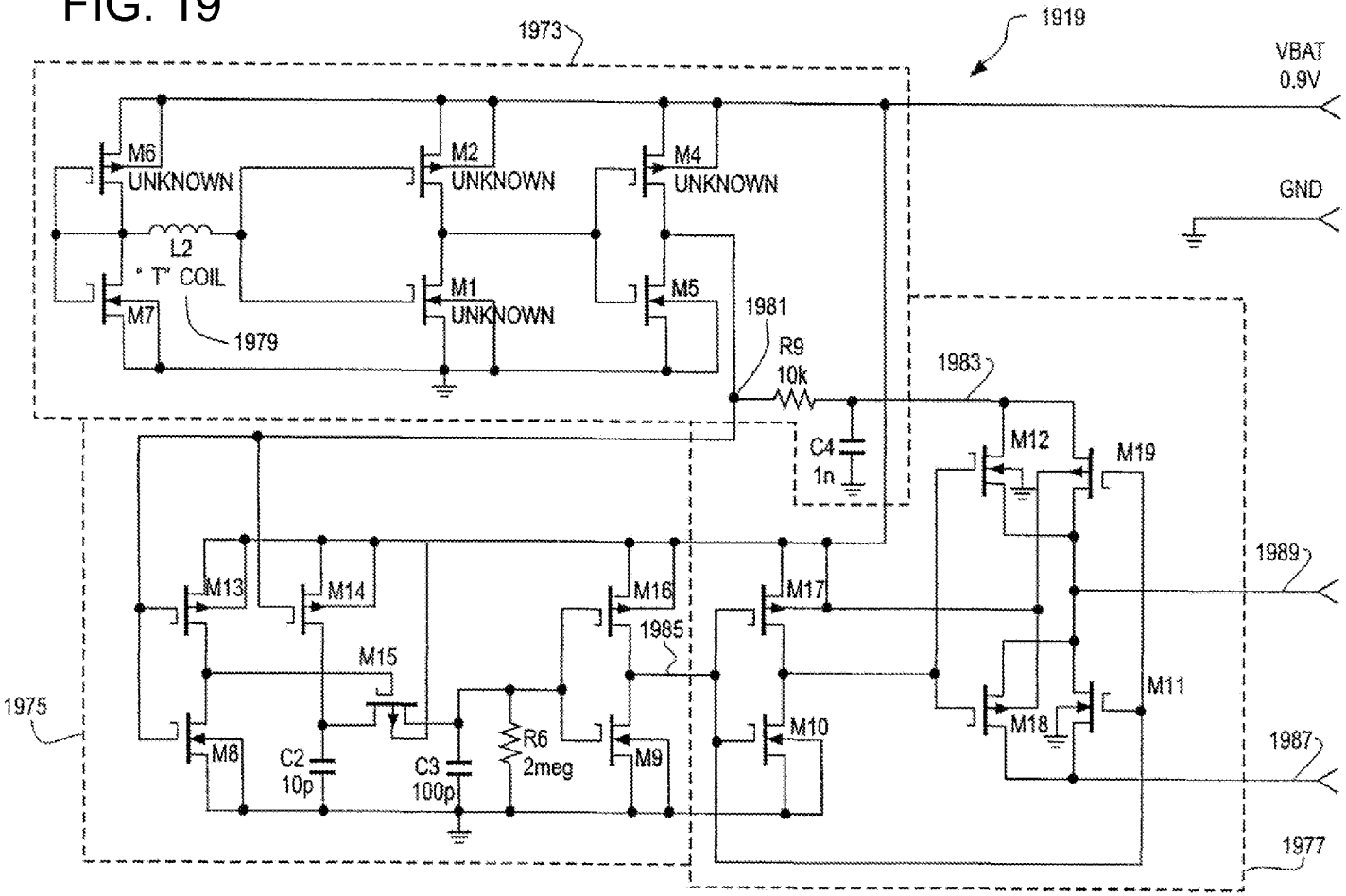
FIG. 19 illustrates one specific circuit implementation of the transmission detection and switch system embodiment of FIG. 16.

FIG. 19 illustrates one specific circuit implementation of the transmission detection and switch system embodiment of FIG. 16. System 1919 comprises a Pulse Width Modulation (PWM) wireless type receiver, a carrier transmission detector and a switch, and is designed to work at a carrier frequency of approximately 100 kHz. The receiver, carrier transmission detector and switch are shown in FIG. 19 by blocks 1973, 1975 and 1977, respectively.

Input to the receiver of block 1973 from the secondary audio source is derived from "T" Coil L2 (illustrated by reference numeral 1979 in FIG. 19). Also in the receiver of block 1973, components M1/M2 and M4/M5 comprise a two-stage amplifier biased by components M6/M7. The output 1981 of the receiver of block 1973, which output represents an un-demodulated 100 kHz carrier signal, is filtered using a single pole at 10 kHz (low pass) filter to produce a demodulated signal 1983 (i.e., a demodulation of the 100 kHz PWM transmission signal).

As mentioned above, the carrier transmission detector is shown in FIG. 19 by block 1975. The output 1981 of the receiver of block 1973, which output, as mentioned above, represents an un-demodulated 100 kHz carrier signal, is "charged pumped/integrated" by components M8, M13, M14, M15, C2, C3, R6 and comparator M9/M16 of the carrier transmission detector of block 1975 to perform a carrier detect function with a nominal 50 kHz threshold detection frequency. The output 1985 of comparator M9/M16 drives the switch, which, as mentioned above, is shown in block 1977.

The switch in block 1977 is comprised of components M10, M11, M12, M17, M18 and M19. When the carrier frequency as determined at output 1985 is greater than 50 kHz, the switch selects signal 1983, representing the audio output of the receiver (from the secondary audio source). When the carrier frequency as determined at output 1985 is not greater than 50 kHz, the switch selects signal 1987, representing the output of the primary audio source. In either case, the selected signal is connected to output 1989, the output of the electronic switch, which in turn is connected to hearing aid circuitry.

It should be understood that, while a specific embodiment is shown in FIG. 19, numerous circuit embodiments may be implemented to carry out the general functionality of FIG. 16, as well as that of FIGS. 17 and 18. In addition, digital signal processing may also be used to carry out such functionality.

Figure 20:
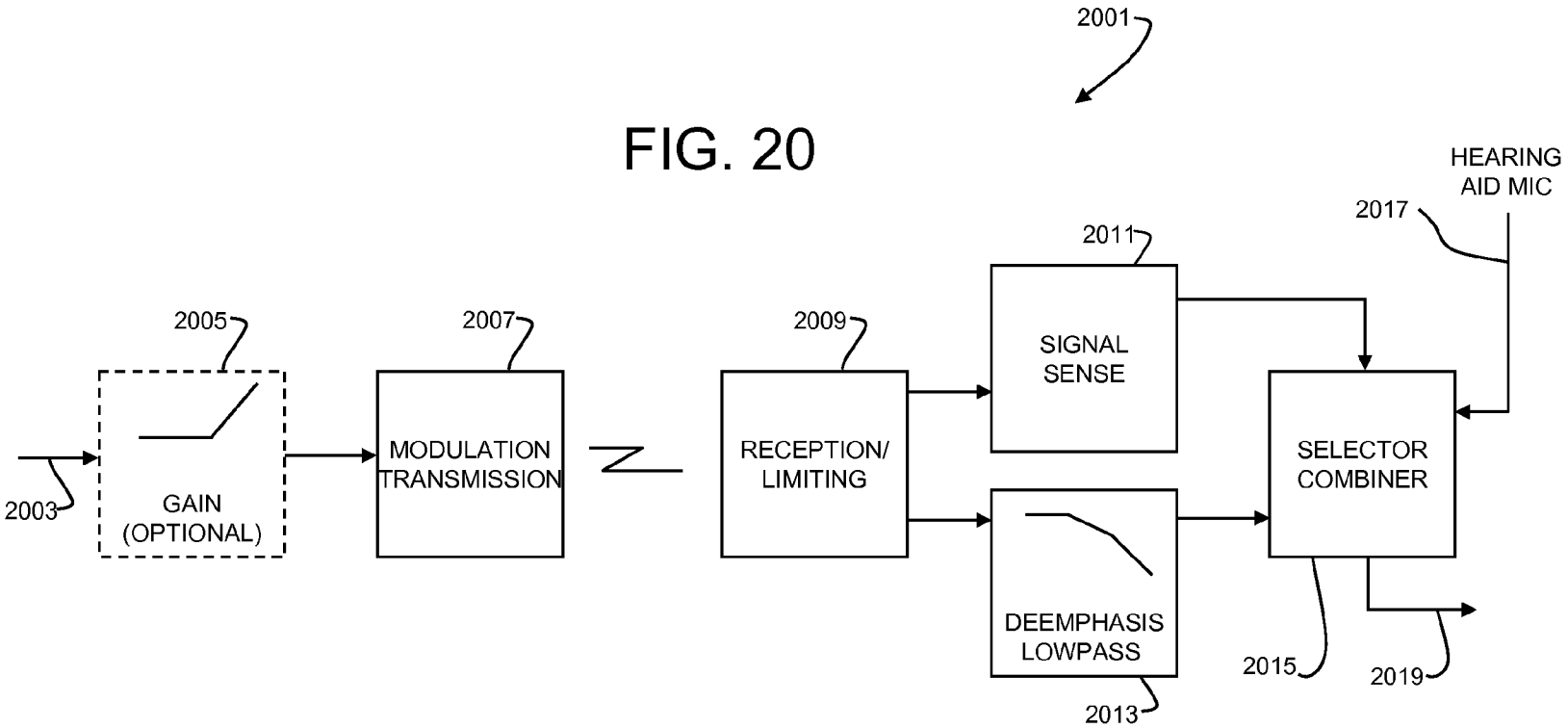
FIG. 20 is a general block diagram of an inductively coupled hearing improvement system in accordance with the present invention.

FIG. 20 is a general block diagram of an inductively coupled hearing improvement system 2001 in accordance with the present invention. An audio frequency signal 2003, which is to be inductively coupled to a hearing aid, is input to an optional gain stage block 2005. The gain stage block 2005 applies an appropriate signal level to a modulation/transmission block 2007, such that, eventually after reception and demodulation, an appropriate signal level is presented to circuitry of the hearing aid. The gain stage block 2005 may also optionally provide high frequency pre-emphasis (boost).

In the modulation/transmission block 2007, the modified signal from the gain block modulates a carrier of typically 100 kHz by some means for application to a transmitting inductor or other type of antenna. The transmitting inductor responsively generates a corresponding changing magnetic flux field. A reception/limiting block 2009 includes a receiving inductor some distance away from the transmitting inductor, which responds to the flux field at an attenuated level. The electrical signal produced by the receiving inductor is amplified by an amplifier sufficiently such that the amplifier output signal is limited (clipped) under normal operating conditions, and, thus, constant amplifier output signal level is maintained. The signal at this point is largely free of interfering noises, since the noises are attenuated greatly by the limiting action.

The reception/limiting block 2009 may or may not need to incorporate additional signal demodulation, depending on the modulation method employed, as will be seen in the descriptions of the following figures.

The reception/limiting block 2009 feeds both a signal sense block 2011 and a deemphasis/lowpass filter block 2013. The signal sense block 2011 determines if there is a received signal of sufficient quality to enable passing the demodulated signal on to the hearing aid circuitry. The signal sense block 2011 will typically make the decision based on whether the output signal of the previous block (i.e., block 2009) is firmly in limiting. It could also, for example, respond directly to received signal strength, respond to the level of demodulated ultrasonic noise, or could operate in some other manner.

The deemphasis/lowpass filter block 2013 employs a lowpass filter to substantially remove components of the high frequency carrier before application to the hearing aid circuitry, without substantially affecting the desired audio frequency signals. This filtering block may also provide some high frequency deemphasis (rolloff) to compensate for the initial transmitter preemphasis and restore a flat overall audio frequency range response. Such emphasis/deemphasis action reduces the higher frequency noise within the audio frequency range in the received, demodulated signal.

A selector/combiner block 2015 receives the demodulated, filtered, inductively-coupled signal and a hearing aid microphone signal 2017. At rest (meaning that no high quality inductively coupled signal is being received), the selector/combiner block 2015 passes the hearing aid microphone signal through unchanged to the remainder of the hearing aid circuitry (see, output 2019), while blocking any received signal. When the signal sense block 2011 determines that a sufficiently high quality signal is being received, it causes the selector/combiner block 2015 to pass this signal through to the hearing aid circuitry. The hearing aid microphone signal may be attenuated to reduce interfering environmental sounds for the user. This attenuation could be total, but will most often be more useful if the attenuation is limited to about 15 dB or so. This allows an acoustic room presence to be maintained when the coupled signal does not contain this information (as would an eyeglass-mounted highly directional microphone, for example). When selected, the coupled signal will normally still dominate over the hearing aid microphone signal, irrespective of the nature or source of the signal.

Figure 21:
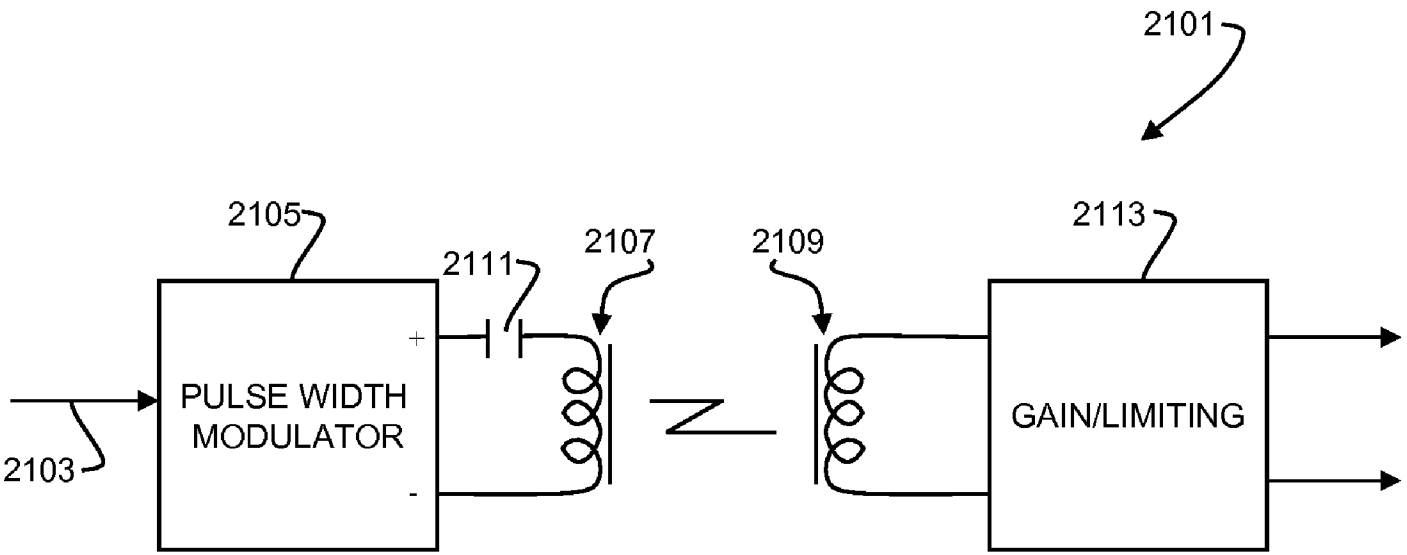
FIG. 21 illustrates a pulse width modulation system that may be used for the modulation/transmission and reception/limiting blocks of FIG. 20.

FIG. 21 illustrates a pulse width modulation system 2101 that may be used for the modulation/transmission and reception/limiting blocks of FIG. 20. In the pulse width modulation (PWM) system 2101, the gain-adjusted, pre-emphasized input signal 2103 (i.e., signal 2003 of FIG. 20) is applied to a pulse width modulator 2105. The carrier frequency is typically 100 kHz, which is well above the audio frequency range, allowing good separation of the audio and carrier information upon reception, but not so high as to make reception with very low voltage, very low power receiving circuitry difficult. The modulator circuit outputs opposite polarities of a rectangular signal whose mark/space ratio varies with the instantaneous value of the audio frequency signal input. These modulator output signals differentially drive a transmit inductor 2107.

The coupling from the transmit inductor 2107 to a physically separated receive inductor 2109 may selectively be weak. The coupling is dependent on the respective inductors' dimensions, their individual inductances, and very strongly on their separation distance. Empirically it has been found that the voltage input to voltage output coupling ratio is proportional to the core length of each inductor, roughly to the square root of the ratio of their core diameters, to the square root of the ratio of their inductances, and proportional roughly to the 2.75th power of their separation distance (at least for inductors of the approximate size and construction, and operated under the moderately separated distances and moderate frequencies studied). This can be expressed by the following empirical formula for inductors positioned end-to-end, where the dimensions are in millimeters and the result in decibels:

$$\text{coupling} = 10\log\left[\frac{L_{RX}}{L_{TX}}\right] + 10\log[dia_{RX} \times dia_{TX}] + 20\log[\text{length}_{RX} \times \text{length}_{TX}] - 55\log[\text{distance}] - 12$$

For inductors positioned side-to-side, the coupling is 6 dB less. At other orientations, coupling is variable, but can be at a null when the receive inductor 2109 core is aligned perpendicularly to the lines of flux of the transmitting inductor. For the PWM transmit and receive inductors 2107 and 2109, respectively, described more completely below, the loss given by the formula is predicted to be 25 dB at a 1 cm center-to-center spacing and 63 dB for a 5 cm spacing. The loss is greater for other relative orientations.

For a short range transmitter circuit powered by a single-cell hearing aid battery with a typical voltage of 1.3 volts, a 1 mH inductor wound on a ferrite core of diameter 1.6 mm and length 6.6 mm may be used for a compact transmitter design with reasonable transmission efficiency. Employing a low loss ferrite core inductor improves transmitter efficiency by allowing most of the stored inductor energy to be returned to the battery each cycle, instead of being dissipated in the inductor core. Peak inductor current is about 3.25 mA, but average battery current is only about 400 uA (exclusive of input circuitry), with efficient mosfet H-bridge drive transistors.

A 0.1 uF coupling capacitor 2111 forms a high-pass filter with the transmit inductor 2107, rolling off the voltage applied to the transmit inductor 2107 at 12 dB/octave below 16 kHz. The frequency is chosen to be high enough to allow large attenuation of the baseband audio frequency content while being low enough to preserve the waveform shape of the rectangular signal applied to the transmit inductor 2107. The audio frequency components of the spectrum may be attenuated to avoid the large currents that would otherwise flow into the transmit inductor 2107, which has been sized for proper transmission of the much higher frequency carrier. The resulting rectangular voltage waveform which is applied to the transmit inductor 2107 changes its peak positive and negative levels under modulation along with its mark/space ratio such as to maintain a near zero average voltage level.

The receive inductor 2109 may have a value of about 10 mH at frequencies in the 100 kHz range and be wound on a steel bobbin of overall length 5.5 mm and bobbin diameter 0.6 mm. Receive inductor 2109 configured as such would have an equivalent parallel capacitance of about 9 pF. Together with other stray circuit capacitance, this will result in receive inductor 2109 input circuit with a resonance of about 500 kHz. The received PWM voltage waveform will have harmonics above this frequency rolled off, or equivalently, have its leading edges rounded. Sufficient parallel circuit loading may be added (typically about 50 kOhms) so that, in conjunction with the inductor core losses, the input circuit Q is about 0.7. This choice allows the sharpest leading edge transitions to be received to maintain sensitivity to narrow pulses, while minimizing overshoot and ringing. The overall receive inductor 2109 input circuit frequency response enables adequate waveform fidelity for pulse detection over a full range of transmitted mark/space ratios from 50/50 to 90/10.

The receive inductor 2109 voltage may be amplified approximately 70 dB, for example, by a multistage amplifier 2113 having a sufficiently wide bandwidth so as not to significantly degrade its input signal. (Some bandwidth tradeoff is possible between the amplifier and the inductor circuit: i.e., widening the inductor circuit bandwidth or increasing the Q slightly to allow some effective reductions in each of these by the amplifier.) The amplifier 2113 is designed such as to not exhibit behavioral problems over a very wide range of input signal levels, corresponding to differing transmit-receive inductor spacings and orientations. The amplifier 2113 is also designed to cleanly and stablely limit the output signal to consistent high and low levels. The high and low levels may be separated by two Shottky or PN junction diode drops. The amplifier 2113 will be in a limiting condition whenever the received signal is usable. By restoring consistent high and low levels to the PWM signal, the baseband audio frequency content is also restored. This can be considered a form of demodulation, in that only filtering to remove the (now unwanted) carrier signal is needed to restore the original audio frequency range signal.

In the PWM signal, the audio modulation information is carried by the timing of the transitions. It is possible to transmit greater peak flux rates of change for the same transmitter power consumption by transmitting essentially only those transitions. These transitions can be considered the derivative of the PWM signal. These could be obtained by reducing the value of the coupling capacitor in FIG. 21, but obtaining strong pulses would require high peak battery and switch currents, with very low drain during most of the cycle.

Figure 22:
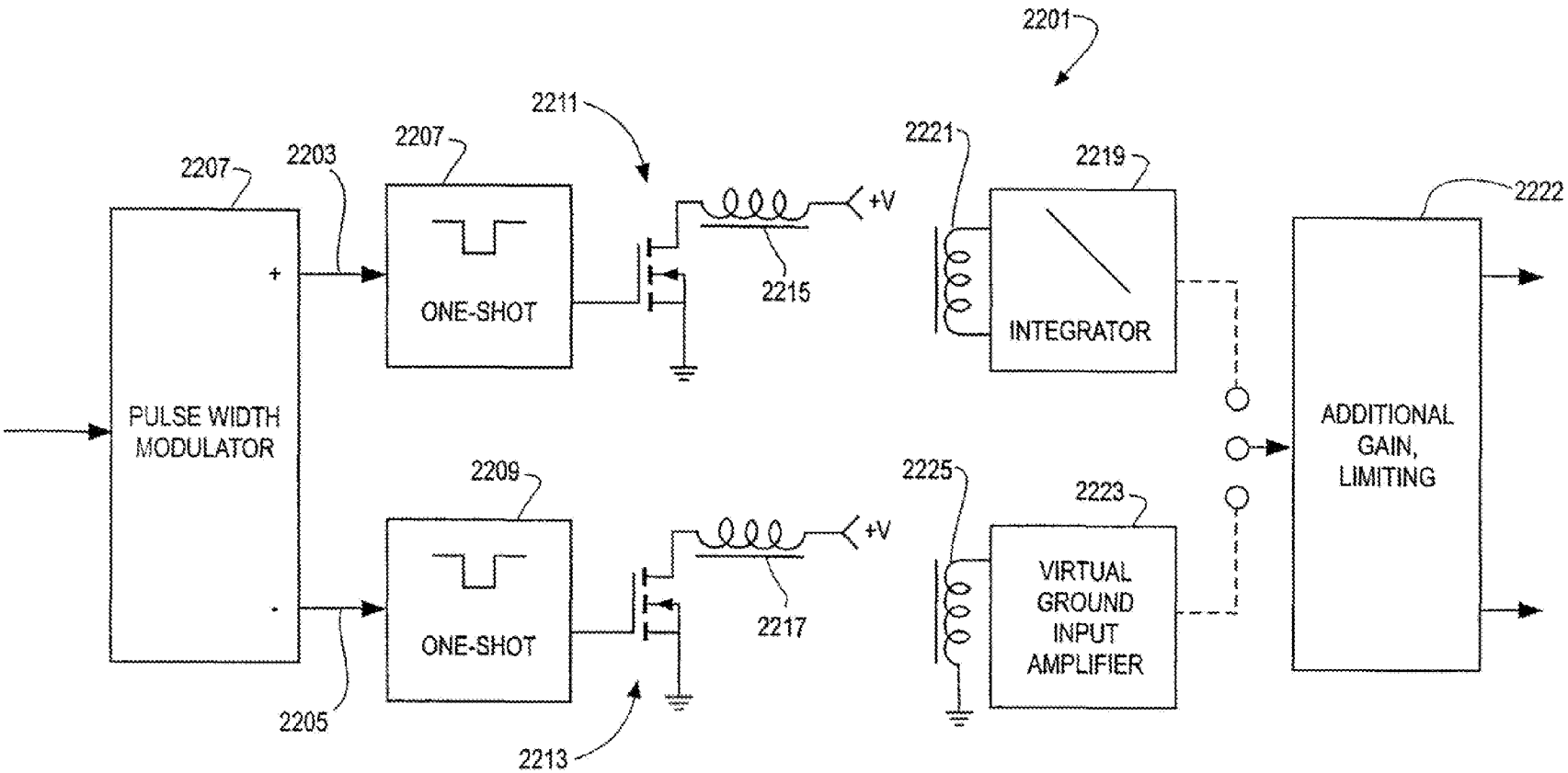
FIG. 22 shows a system to obtain large transition spikes with lower, more continuous battery and switch currents in accordance with one embodiment of the present invention.

FIG. 22 shows a system 2201 to obtain large transition spikes with lower, more continuous battery and switch currents. Opposite polarity outputs 2203 and 2205 of a low power 100 kHz pulse width modulator 2207 each trigger a respective 1.5 usec, for example, one-shot monostable multivibrator (i.e., one-shots 2207 and 2209). These, in turn, each turn off a corresponding switch (i.e., switches 2211 and 2213) for that time period on opposite PWM signal transitions. Each switch normally connects an associated inductor (i.e., inductors 2215 and 2217) to ground. The opposite end of each of the inductors 2215 and 2217 is connected to the positive voltage supply. During most of the cycle, each of the inductors 2215 and 2217 is being charged with current. When an associated switch opens in response to its associated one-shot, the inductor voltage rings up to a voltage many times the supply voltage before ringing back down to discharge its remaining reversed current into a reverse catch diode associated with the switch. This ring will last for just over one-half cycle of the inductor circuit resonant frequency. The inductors 2215 and 2217 are normally arranged in opposition, so that each alternating spike generates a changing flux field of opposite, alternating polarity. Depending on the demodulation method chosen, the spikes could alternatively be made to go in the same direction.

For a 1.3 volt short range transmitter, low-loss 3 mH inductors wound on the cores previously described for the PWM transmitter may be used. These will have in-circuit resonances of 500 kHz, resulting in 1 usec pulses of approximately 13 volt peak amplitude, depending on battery voltage. Each of the inductors 2215 and 2217 can achieve peak currents of about 1.7 mA, yet the average battery drain of both inductor circuits, with efficient switches, is about 400 uA (exclusive of input and PWM circuitry).

The switches 2211 and 2213 are shown in FIG. 22 as N-channel enhancement mode mosfet switches. These may be used due to their low switching losses, inherent reverse catch diode, and ability to conduct both directions of current with low loss when switched on. The timing of the one-shots 2207 and 2209 may be reliably just greater than the ring-back time of their respective inductors, so that the transistor can quickly revert to a low loss condition following the return of reverse current flow, with minimal time spent relying on the catch diode. The mosfet may have a <1 volt turn-on gate voltage and the ability to withstand >13 volt drain-source spikes.

In order to receive most of the available signal strength of the transmitted signal and not excessively lengthen the signal's rise and fall times, and assuming conventional sensing and amplification of receive inductor voltage, a receive inductor circuit for FIG. 22 may have a resonant frequency at least as great as, and preferably greater than the transmit inductors 2215 and 2217. A 3 mH inductor may be used, wound on a the same steel bobbin as just described for the PWM receiver can have an in-circuit resonance of 800 kHz. The Q may be controlled to about 0.7 with parallel resistive loading in conjunction with the core loss, to prevent excessive ringing while maintaining adequate pulse rise and fall times.

FIG. 22 suggests two potential means of obtaining a PWM-equivalent signal. In a integrator block 2219, a receive inductor 2221 voltage is amplified and integrated. If the received signal, with its opposite polarity spikes, is simply integrated as such, then an equivalent PWM signal is recovered. It can be also be amplified, limited, and filtered by circuitry of block 2222 in the same manner as discussed in connection with FIG. 21.

Alternatively, in a block 2223, the receive inductor 2225 is operated into a virtual ground amplifier input. The amplifier senses directly the received flux level, which is already proportional to the integral of the summed transmitter inductor voltages. Once the PWM-equivalent signal is obtained, it can likewise also be amplified, limited, and filtered by circuitry of block 2222 in the same manner as discussed in connection with FIG. 21.

In this virtual ground amplifier configuration, the circuit sensitivity to equivalent parallel inductor capacitance and resistance is low. A roughly 3 mH inductor value may be used, as discussed more completely below.

Another possible method of demodulating the audio information from the received pulses is to sense the peak recovered positive and negative signal amplitudes, ignore all signals of lesser amplitude, set and reset a flip-flop, and then low pass filter the flip-flop output.

To enhance the system's rejection of interferences and possibly allow for multi-channel operation, frequency modulation ("FM") may be used instead of the pulse width based systems discussed with respect to FIGS. 21 and 22. FIG. 23 illustrates a FM system 2301 in accordance with the present invention. Roughly +/−10 kHz peak deviation of a 100 kHz carrier may be used. Since, unlike the previously discussed modulation methods, harmonics of the carrier frequency are not needed, the transmit inductor drive circuit may be operated into an inductor circuit which is mildly resonant in the region of the carrier frequency, thus enhancing the proportion of energy maintained in the waveform fundamental.

Figure 23A:
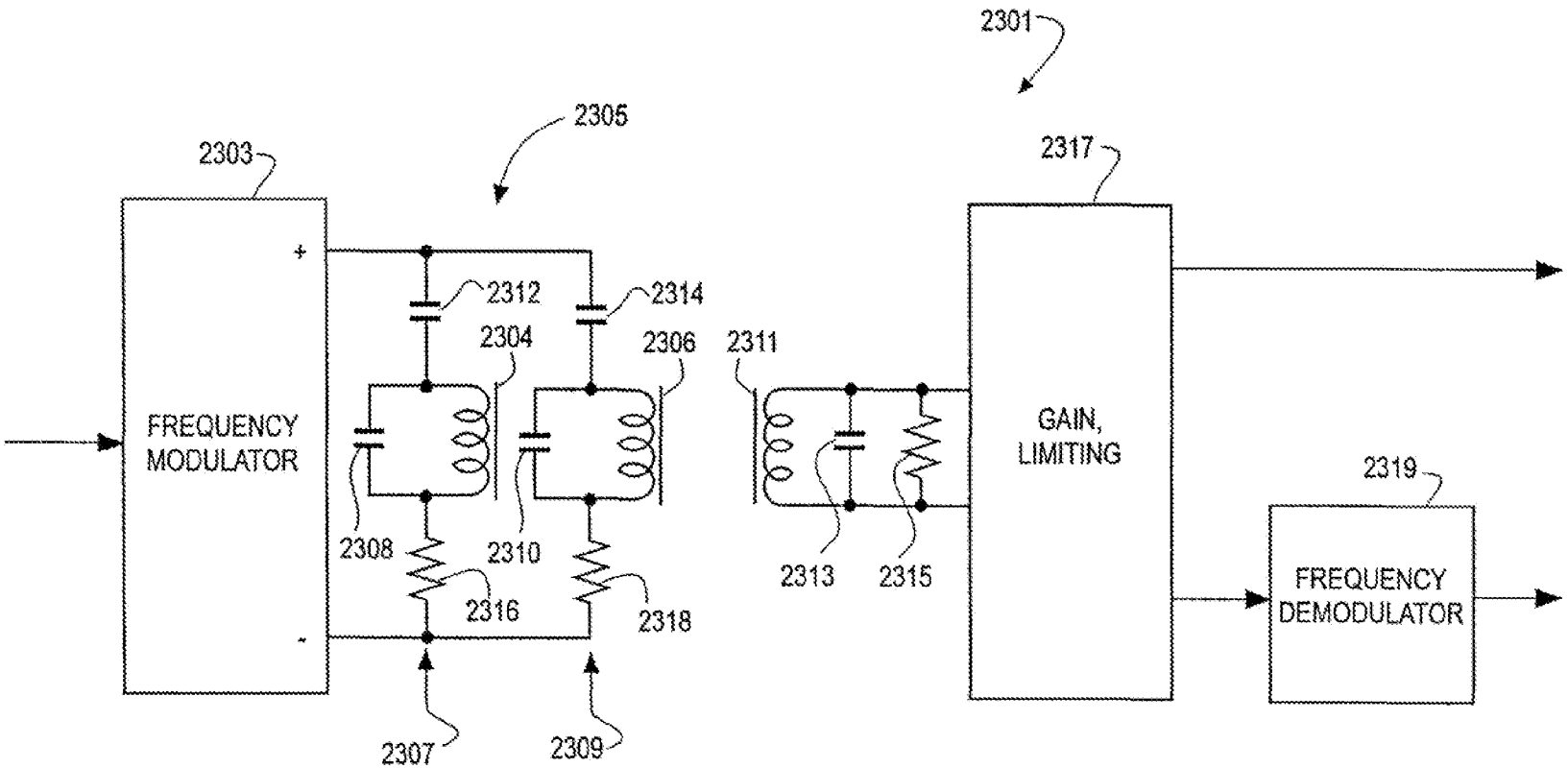
FIG. 23A illustrates a frequency modulation system in accordance with the present invention.
Figure 23B:
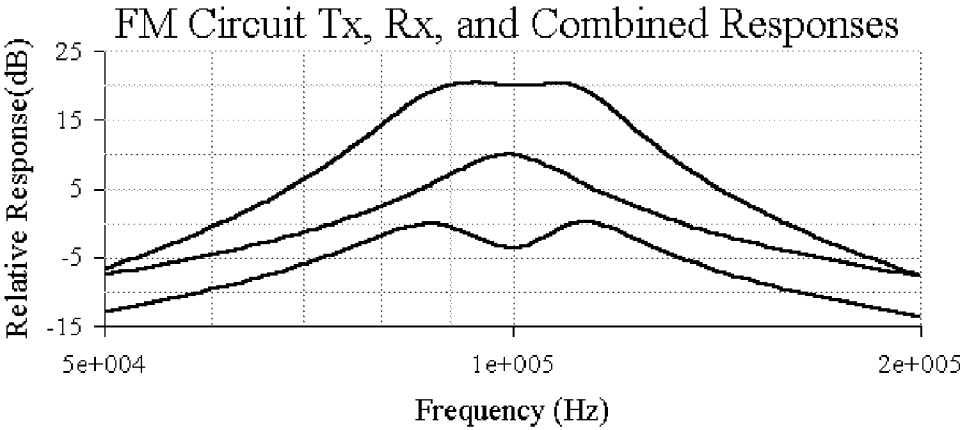
FIG. 23B illustrates curves that represent the transmitted flux frequency response (lower curve), the received flux frequency response (middle curve), and the net inductor-to-inductor frequency response (upper curve) for the system 2301 of FIG. 23A.

In FIG. 23A, a frequency modulator 2303 provides a frequency modulated square wave drive to a transmit inductor network 2305. In order to provide a reasonably flat amplitude response and linear phase response over a 20 kHz band around 100 kHz, dual resonant inductor circuits 2307 and 2309, stagger-tuned on either side of 100 kHz may employed. When combined with a single resonant receive inductor circuit, the net transmit-receive frequency response achieves a flat pass-band. The curves of FIG. 23B represent the transmitted flux frequency response (lower curve), the received flux frequency response (middle curve), and the net inductor-to-inductor frequency response (upper curve) for the system 2301 of FIG. 23A.

A low voltage, low power short range transmitter network, such as network 2305, may comprise 10 mH ferrite core inductors 2304 and 2306 of the dimensions previously discussed, for example, equivalent parallel capacitors 2308 and 2310 (having capacitance of 30 pF, for example), added series capacitance 2312 and 2314 (having capacitance of 297 and 174 pF, respectively, for example), and total series resistors 2316 and 2318 (having 1.3 and 1.4 kOhm resistances, respectively, for example) in the configuration shown in FIG. 23. This configuration gives resonances for the circuits 2307 and 2309 at 88 kHz and 111 kHz, both with Q's of about 5. Assuming an efficient mosfet H-bridge drive circuit is used, the peak joint inductor current will be about 850 uA with an average battery current (exclusive of input circuitry) of about 600 uA.

A receive inductor 2311 may be of a much higher value than with the other modulation approaches, which allows a significant increase in sensitivity. A 100 mH inductor wound on the steel bobbin previously described can have a 99 kHz resonance using a total circuit+inductor capacitor 2313 having a capacitance of 26 pF, for example. In conjunction with a resistor 2315 having 340 kOhm of total equivalent and actual parallel loading resistance, for example, a Q of just over 5 results. The combination of high inductor value and under-damped response allows a very high effective sensitivity. A limiting amplifier 2317 that follows can have significantly less gain than the previous systems. The limited amplifier output signal contains no base-band audio content and must be demodulated by a block 2319 using any of the known FM demodulation methods.

The transmitted FM signal of a system such as shown in FIG. 23 has significantly less harmonic content than do the other described transmitters, but some high frequency content may remain due to the original square wave drive. This high frequency content may be further reduced by additional filtering between the drive circuitry and the transmitting inductor, utilizing very small or well-shielded inductors with minimal radiating potential.

FIGS. 24-27 show in detail circuitry that may be employed to implement the pulse width modulation embodiment of FIGS. 20 and 21. The input signal may be derived from an eyeglass-mounted highly directional array microphone. The transmitter circuitry may also be mounted on the eyeglass. Both the array microphone and the transmitter may be powered by a single 1.5 volt nominal hearing aid battery. The receiver circuitry provides automatic switchover from an ear canal mountable hearing aid type microphone.

Figure 24:
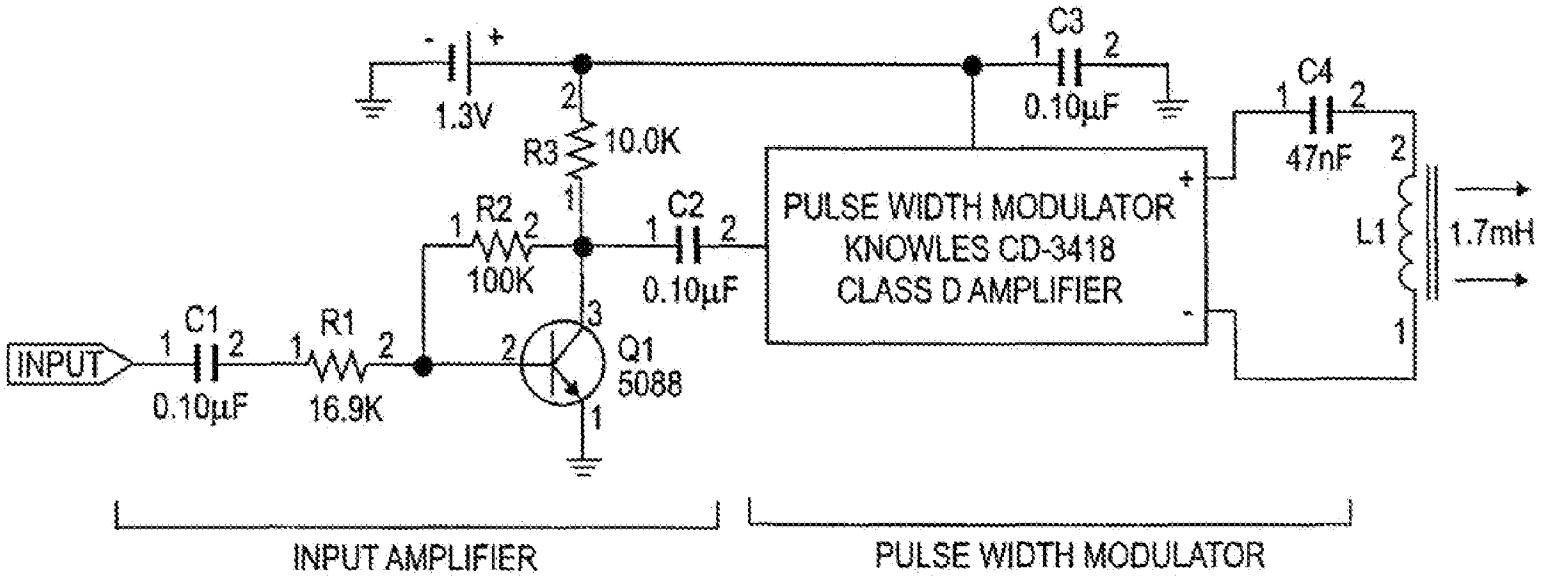
FIG. 24 shows a single stage amplifier that raises an audio frequency input signal strength to an optimum range for a pulse width modulated hybrid in accordance with the present invention.

FIG. 24 corresponds to blocks 2005 and 2007 of FIG. 20, and shows a single stage amplifier that raises the audio frequency input signal strength to the optimum range for the PWM hybrid. This hybrid, a Knowles CD-3418 (ref. Knowles Electronics, Inc. CD Series Data Sheet), is intended for use as a class D audio amplifier for use in driving hearing aid receivers. It does this by providing both output polarities of a pulse width modulated output through a mosfet H-bridge. Blocking capacitor C4 prevents excessive inductor currents that would otherwise result from audio frequencies and DC offset. For convenience, transmit inductor L1 is constructed by the parallel combination of eight Tibbetts Industries, Inc. model Y09-31-BFI telecoils. Total current drain (exclusive of the array microphone) is 750 uA.

Figure 25:
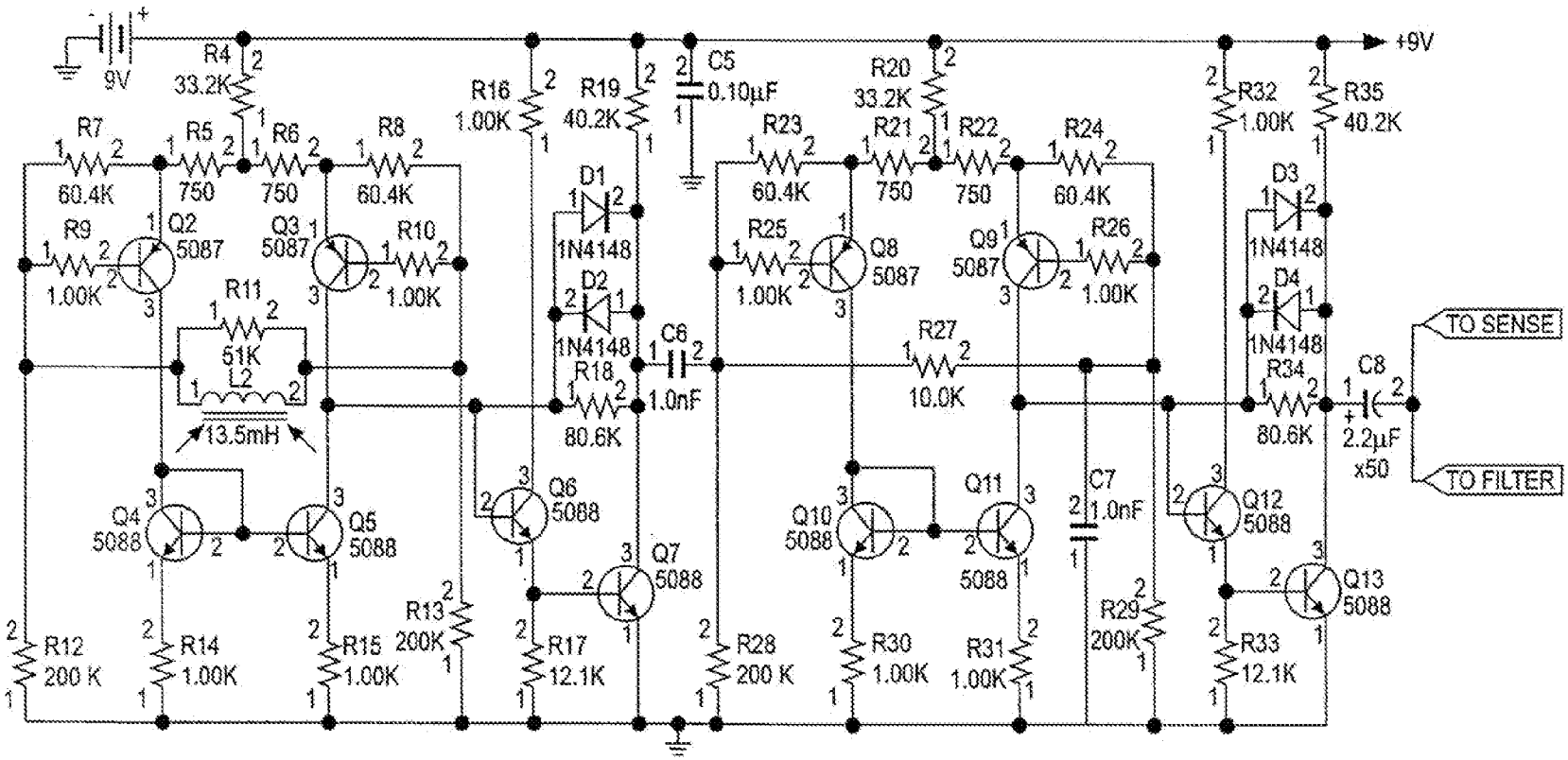
FIG. 25 provides additional exemplary detail regarding a portion of the block diagram in FIG. 20.

FIG. 25 corresponds to block 2009 of FIG. 20. Two cascaded amplifier stages provide a total of 68 dB of gain for the 100 kHz PWM signal received from inductor L2, a Tibbetts Industries, Inc. model Y09-31-BFI telecoil. An input circuit Q of about 0.7 is obtained through the combination of the coil characteristics and the circuit loading, particularly the paralleled 51 kOhm resistor, R11. The output signal amplitude remains at a consistent peak-to-peak level of two silicon diode drops for transmitter-receiver distances from less than 1 cm to roughly 6 to 8 cm (end-to-end coil orientation).

Figure 26:
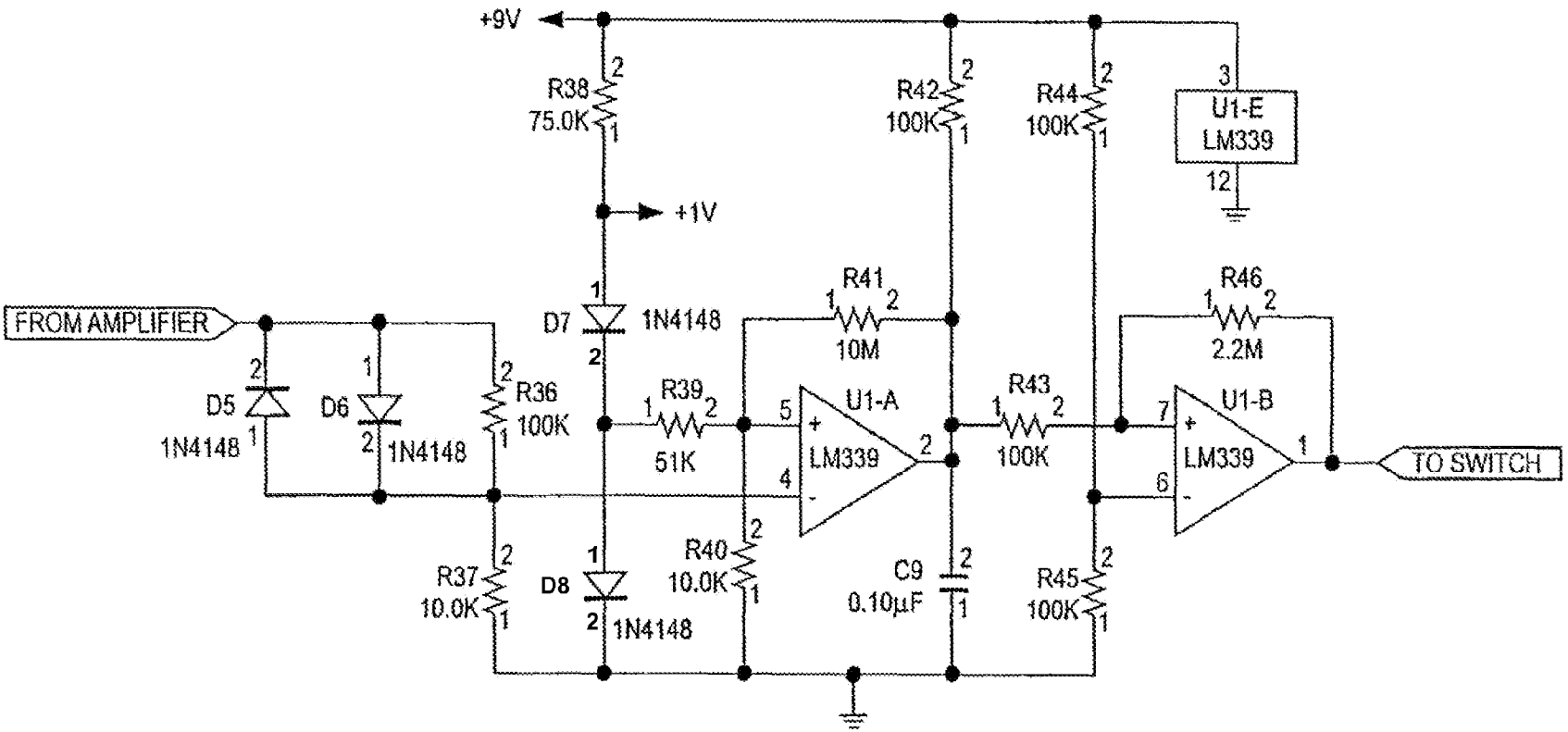
FIG. 26 provides additional exemplary detail regarding another portion of the block diagram in FIG. 20.

FIG. 26 corresponds to block 2011 of FIG. 20. The signal sense circuitry receives a ground-referenced signal from the output of the amplifier. If the amplifier of FIG. 25 is driven sufficiently strongly into limiting at least every 7 msec, indicating adequate received signal strength, the output of this circuit block pulls to ground. This will result in the enabling of the inductively received signal. This circuit also provides a 1 volt supply for the hearing aid microphone.

Figure 27:
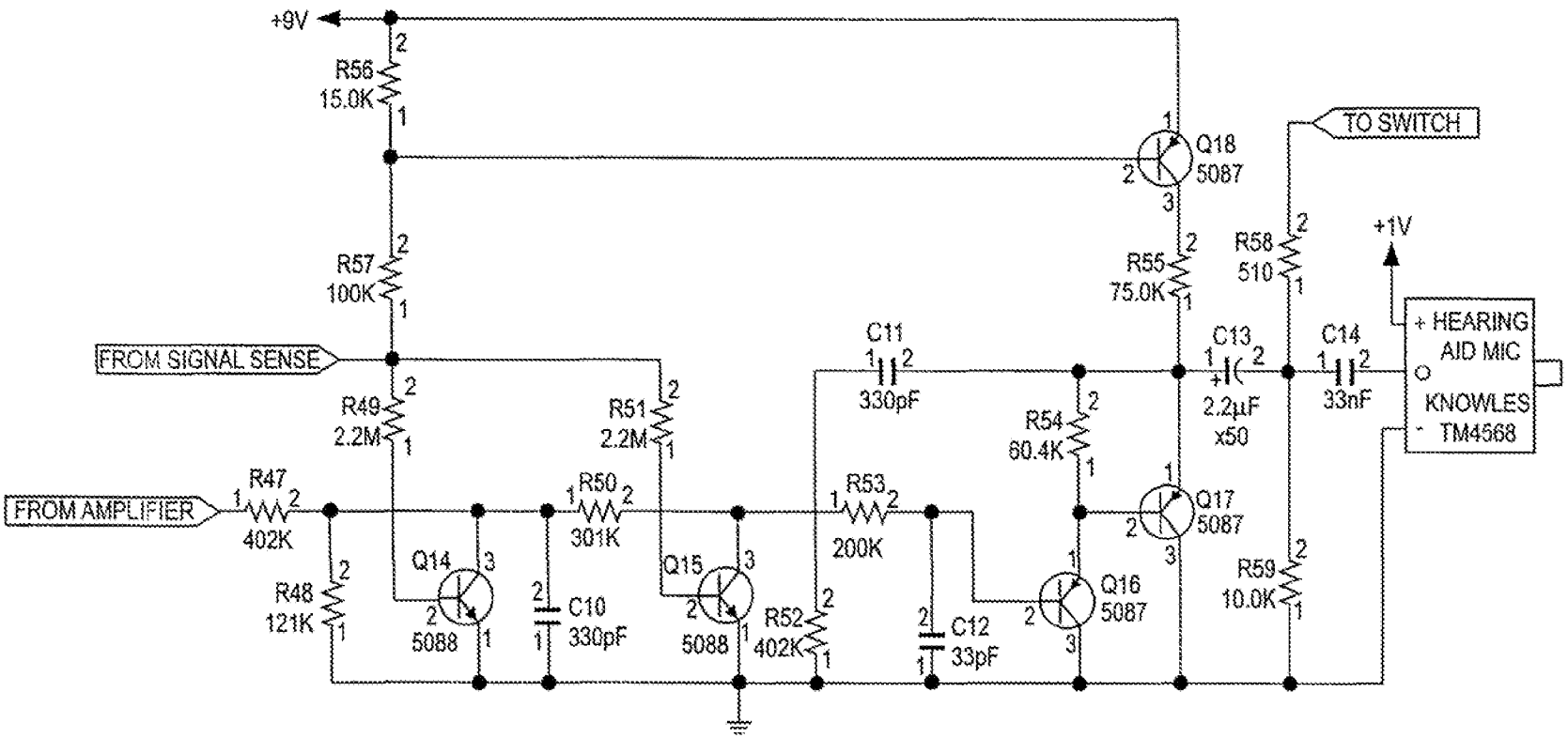
FIG. 27 provides additional exemplary detail regarding other portions of the block diagram in FIG. 20.

FIG. 27 corresponds to the blocks 2013 and 2015 of FIG. 20. When the output of the signal sense block (FIG. 26) is not pulled low, indicating that the inductively coupled signal is not of useful strength, output transistors Q16 and Q17 are not powered up by transistor Q18 and the drive signal to output transistors Q16 and Q17 is shorted to ground by transistors Q14 and Q15. The signal from the hearing aid microphone, in this case a Knowles Electronics, Inc. TM4568, is allowed to pass with virtually no loading or attenuation. When the signal sense output is pulled low, the output transistors are powered up and the signal from the amplifier is allowed to pass through the 3rd order, 6 kHz low pass filter on to the output. The low output impedance of the powered output transistor stage attenuates the hearing aid microphone signal by about 20 dB, so that the inductively received signal may dominate. It may be generally desirable that the hearing aid microphone not be attenuated too deeply, though, so that a sense of the room will not be lost in applications where the inductively coupled signal does not provide such a sense. The degree of attenuation of the hearing aid microphone signal may be reduced from that shown by, for example, reduction of the bias current level in transistor Q17 or insertion of a build-out resistor in series with capacitor C13.

The system described with reference to FIGS. 24-27 above delivers an A-weighted signal-to-noise ratio of about 65 dB, referred to the maximum signal level, at a distance of 2 cm. The system transitions between the hearing aid microphone and the inductively coupled microphone at a distance of 6 to 8 cm, at which point the signal-to-noise ratio is reduced by 15-20 dB from the 2 cm value. The distortion at 1 kHz just below clipping is 1%.

Figure 28:
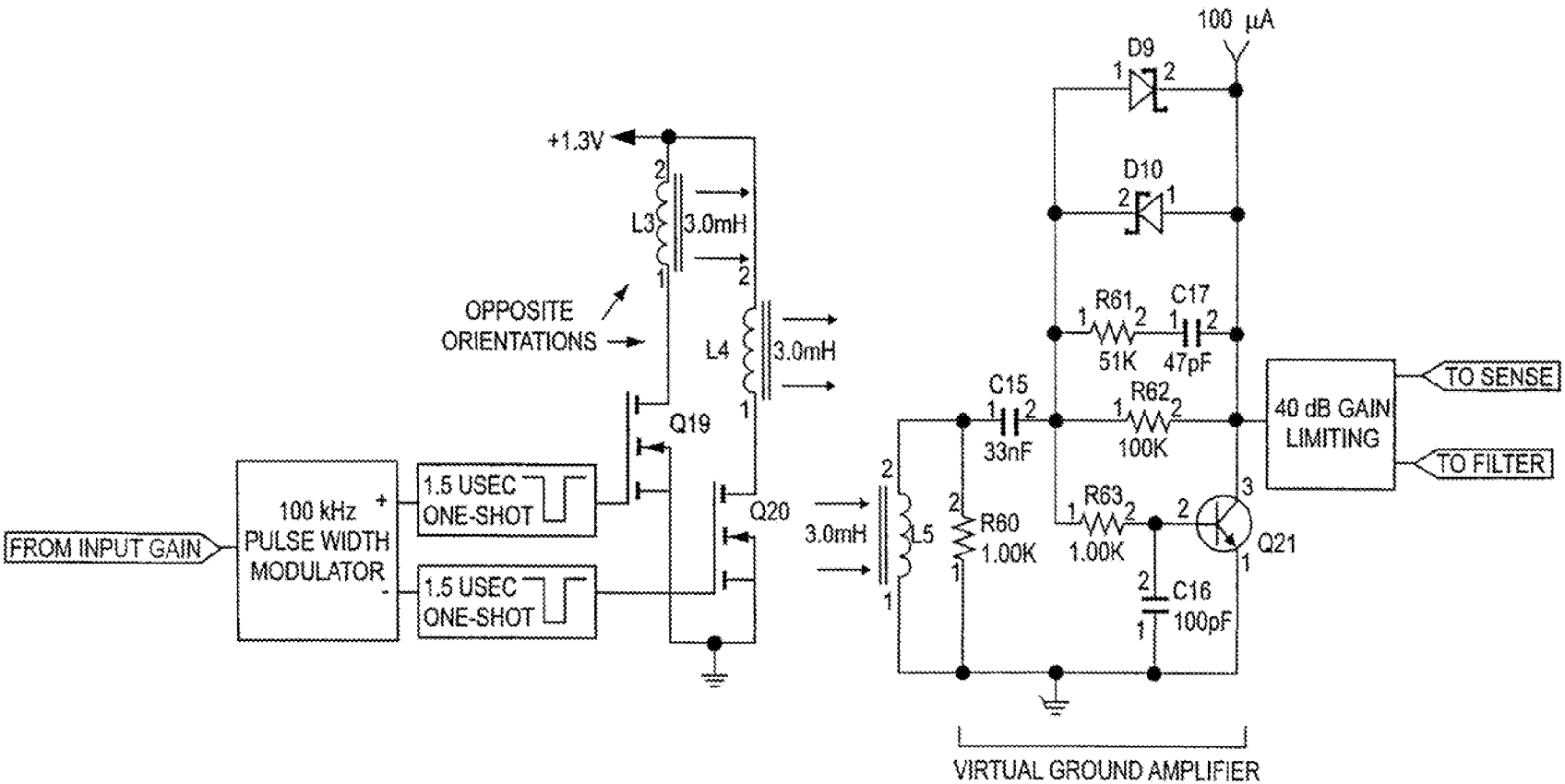
FIG. 28 shows exemplary detail of the circuitry suggested by the block diagram of FIG. 22.

FIG. 28 shows somewhat more exemplary detail of the circuitry suggested by the block diagram of FIG. 22. The 100 kHz pulse width modulator has the same functionality as the similar block in FIG. 24, but with the need only for low power output stages. The one-shot timing may be achieved by any of several known methods.

The virtual ground receive inductor input amplifier shown has an input impedance of about 300 Ohms. This is lower than the inductor impedance at frequencies above 16 kHz. By amplifying the virtual short circuit inductor current, the circuit responds essentially to the induced inductor flux, which is essentially the integral of its open circuit voltage. By amplifying this signal, an equivalent PWM signal appears at the stage output. The lower frequency roll-off and resultant waveform droop in the recovered signal caused by the finite stage input impedance and coupling capacitor C15 can be partially compensated by the shelving feedback network R61, R62, and C17. An advantage of the low stage input impedance is that it enables additional capacitance to be added at the input for improved filtering of radio frequency interference. This is accomplished here by R63 and C16. R60 helps stabilize the stage under overdrive conditions.

Figure 29:
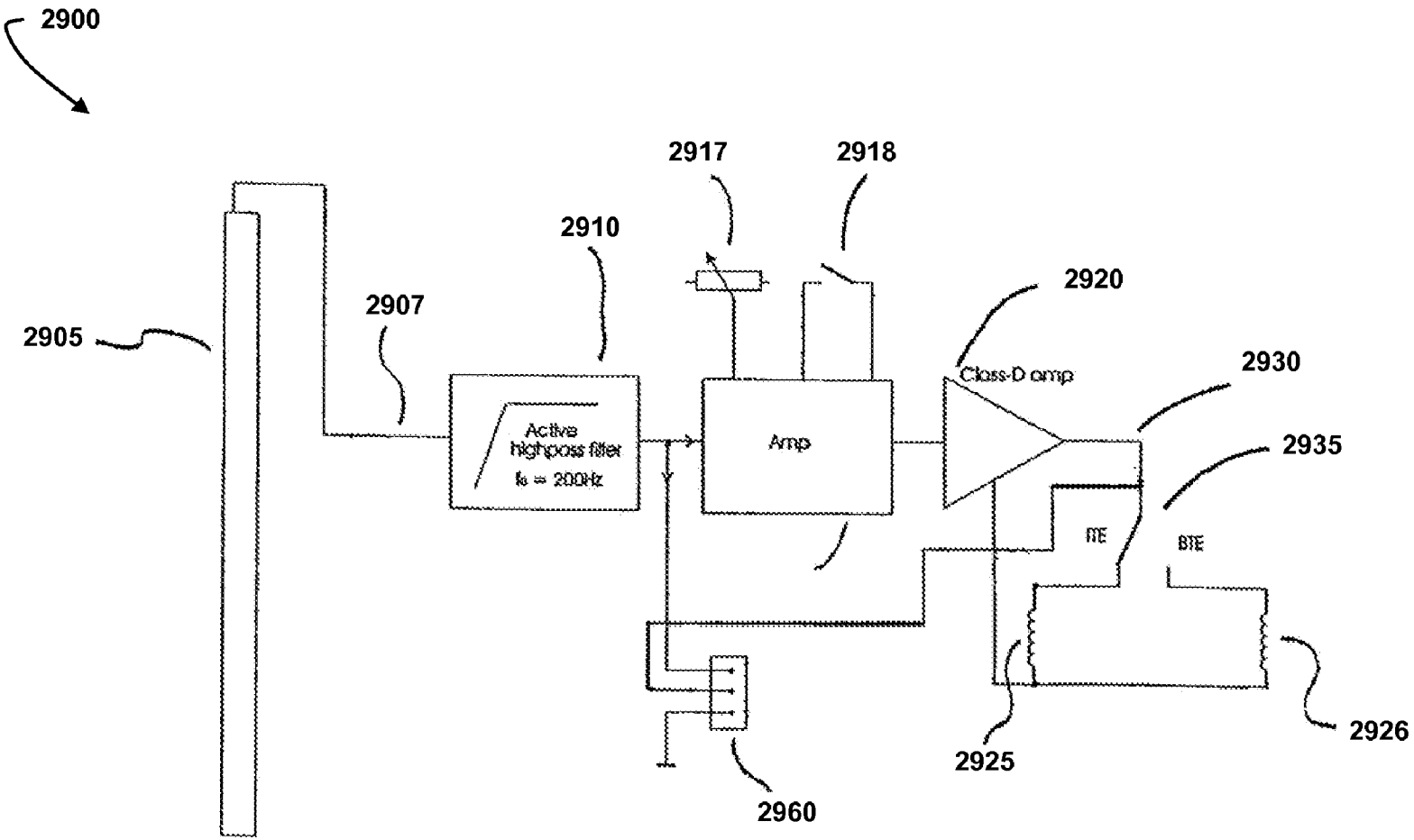
FIG. 29 shows a block diagram corresponding to the block diagram of FIG. 15B, in which the signal from a directional array microphone is amplified and coupled through one of two inductors to the hearing aid of a user, in accordance with an embodiment of the present invention.

FIG. 29 shows a block diagram of another embodiment corresponding to the block diagram of FIG. 15B, in which the signal from a directional array microphone is amplified and coupled through one of two inductors to the hearing aid of a user, in accordance with the present invention. In other embodiments, other electrical signal sources may be substituted for the array microphone. In the exemplary embodiment, separate inductors have been employed to permit the device to generate magnetic fields optimized to more effectively couple with the telecoils contained within ITE and BTE types of hearing aids. In the illustration of FIG. 29, array microphone 2905 transduces a sound field into electrical signal 2907. The array microphone 2905 may be, for example, an array microphone such as that described in patent application Ser. No. 09/517,848, "DIRECTIONAL MICROPHONE ARRAY SYSTEM", filed Mar., 2, 2000, which is hereby incorporated herein by reference in its entirety. The output of array microphone 2905 is connected to the input of high-pass filter 2910, which may be used to reduce low-frequency components of the electrical signal 2907, to avoid excessive low-frequency coupling to a hearing aid unit that may have difficulty processing and making effective use of the signal. High pass filter 2910 may be designed to have a cutoff frequency of approximately 230 Hz. High pass filter 2910 may also be designed to provide a boost to frequencies just above its cutoff frequency, as will be discussed in relation to FIG. 32D.

The output of high-pass filter 2910 is amplified by preamplifier 2915, which provides gain as indicated by the setting of gain control 2917. The microphone signal is then further amplified by class-D amplifier 2920 to produce a typically 100 KHz pulse-width-modulated output signal 2930. Class D amplifier 2920 may be, for example, a Knowles Electronics model CD-3418. As shown in FIG. 29, switch 2935 may be used to connect output signal 2930 to BTE transmit inductor 2926 for use with a BTE-type of hearing aid, or to ITE transmit inductor 2925 for use with a ITE-type of hearing aid. Although the output signal 2930 of class-D amplifier 2920 is a 100 KHz pulse-width-modulated signal, ITE transmit inductor 2925 and BTE transmit inductor 2926 have sufficient inductance to filter nearly all of the 100 KHz component from output signal 2930. The incorporation of Class D amplifier 2920 allows for full 1 volt peak signals to be applied to BTE transmit inductor 2926 or ITE transmit inductor 2925 when circuit power is provided by a small 1.25 volt hearing aid-style battery, while maintaining a low average battery power drain.

Figure 30:
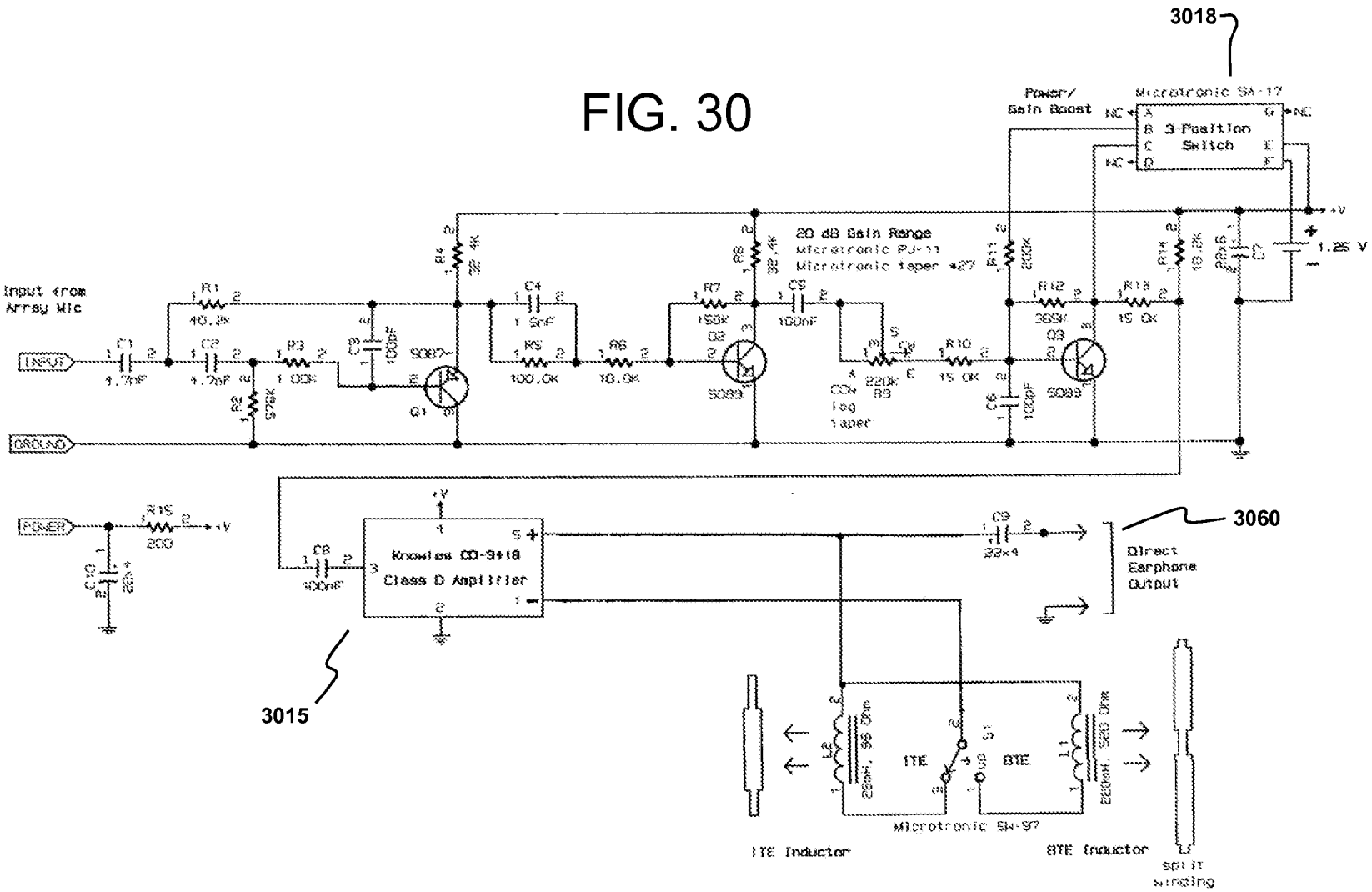
FIG. 30 show a schematic diagram of the circuitry which corresponds to the exemplary embodiment shown in the block diagram of FIG. 29, in accordance with an embodiment of the present invention.

FIG. 30 show a schematic diagram of the circuitry which corresponds to the exemplary embodiment shown in the block diagram of FIG. 29, in accordance with the present invention. FIG. 30 depicts components R1, R2, R4, C1, C2, and Q1, which may correspond to the functionality of high pass filter 2910 of FIG. 29, for example. The resulting signal is amplified by a two-stage preamplifier, corresponding to preamplifier 2915 of FIG. 29, for example, in which the first stage comprises components C4, C5, R5, R6, R7, R8, and Q2. C4 boosts the higher frequencies, as will be discussed further in relation to FIG. 32D. The first stage output is operatively coupled to potentiometer R9, which may correspond to gain control 2917 of FIG. 29, for example. The second stage of the preamplifier comprises components R10, R11, R12, R13, R14, C6, and Q3. Three-position switch 3018, shown in FIG. 30, may correspond to switch 2918 of FIG. 29, and may be, for example, a switch such as a Microtronic model SA-17. When used in combination with R11 of FIG. 30, this switch may allow the gain of the third preamplifier stage to be increased by, for example, approximately 8 dB. The second section of the three-position switch 3018 may provide control of the power needed to operate the circuitry of FIG. 30. The voltage divider formed by R13, R14 may be used to improve the performance of class D amplifier 2920 of FIG. 29, to minimize sensitivity to dynamic battery voltage fluctuations.

FIG. 30 illustrates the arrangement of switch, S1, that may be used for selecting between the two inductors of the present embodiment. Switch S1 of FIG. 30 may correspond to switch 2935 of FIG. 29, and may be used to select either the ITE transmit inductor, L2, which may correspond to ITE transmit inductor 2925 of FIG. 29, for example, or the BTE transmit inductor, L1, which may correspond to BTE transmit inductor 2926 of FIG. 29, for example.

In general, hearing aids with telecoils are designed to expect field strengths of approximately 30 mA/meter at 1 kHz, which corresponds to normal speech levels (from telephone receivers, etc.). The magnetic field strength required for speech peaks, however, may rise high above this, making it advantageous to provide 200 or 300 mA/m, even under well-controlled conditions. A magnetic coupling system expected to handle a wide range of signal inputs without distortion or overload may need to be capable of levels greater than 1 A/m. In addition, environmental magnetic noise levels may be high enough to cause significant interference to telecoil pickup. A quiet home environment may have background magnetic noise levels as low as approximately 1 mA/m, but this can easily reach the 5 mA/m range in a typical office environment or 30 mA/m at a distance of three feet from a cellular telephone. Speech in a magnetic coupling system may need to be transmitted at a much higher average level than any interfering noise, in order to avoid the user experiencing annoying hums and buzzes. This consideration concerning environmental magnetic noise also supports the above stated desirability of achieving magnetic coupling system field levels of 1 A/m or more.

Figure 30A:
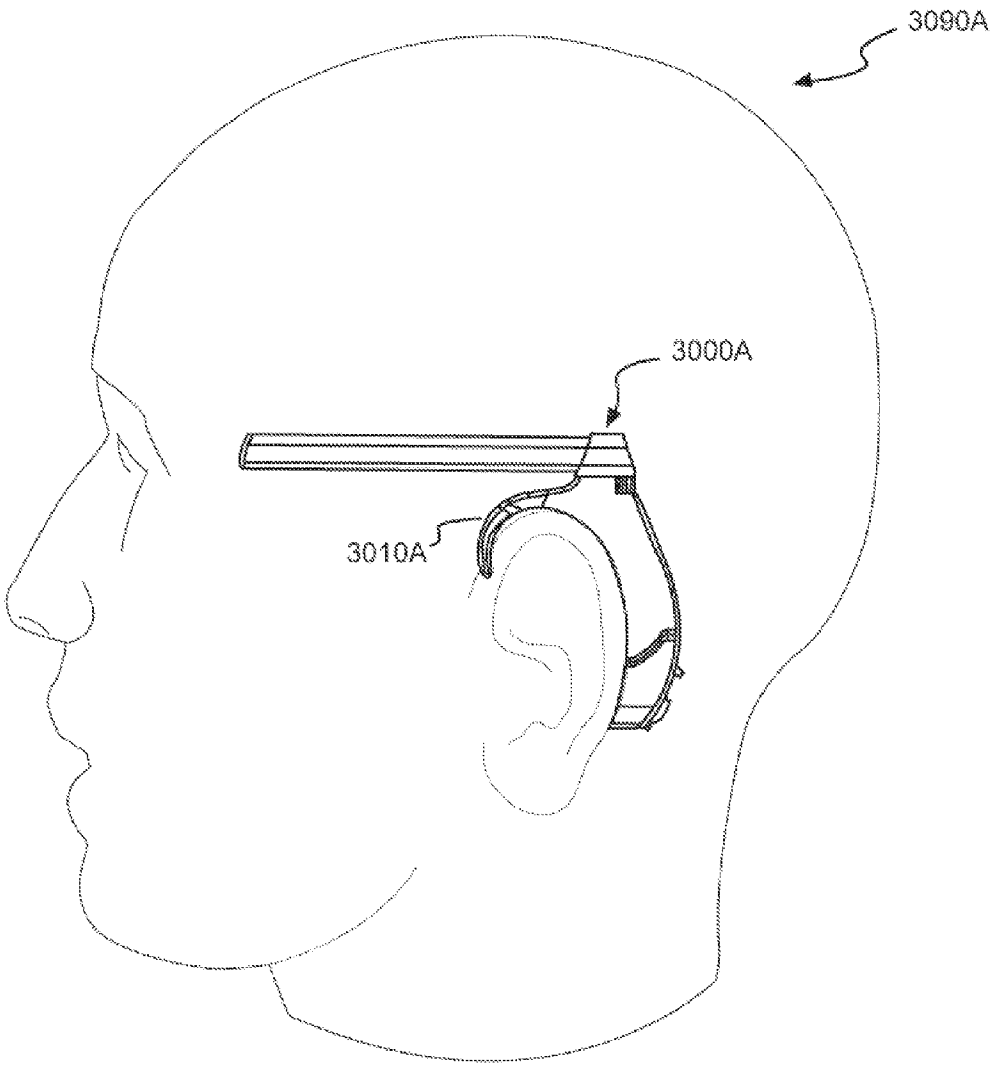
FIG. 30A illustrates a side view of a user wearing an exemplary hearing improvement device, in accordance with an embodiment of the present invention.

FIG. 30A illustrates a side view of a user wearing an exemplary embodiment of a hearing improvement device, in accordance with the present invention. In the illustration of FIG. 30A, hearing improvement device 3000A is held in typical operating position on the ear of a user 3090A by earhook 3010A. The main housing of hearing improvement device 3000A is positioned behind the outer ear, between the outer ear and the head of user 3090A.

Figure 30B:
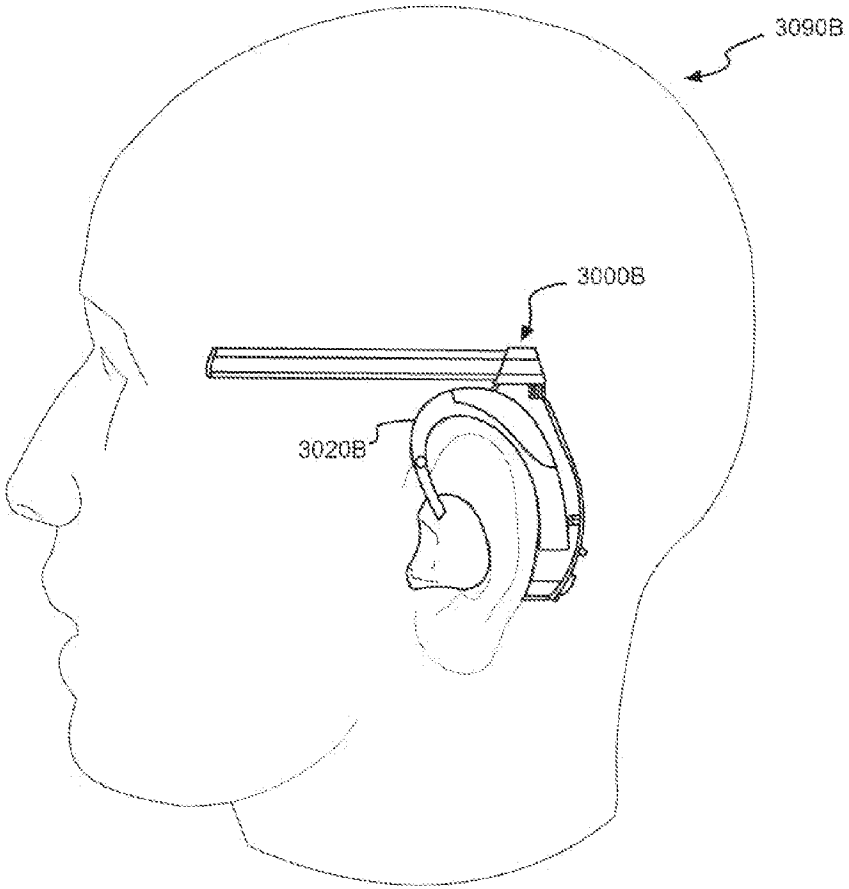
FIG. 30B illustrates the use of an embodiment of a hearing improvement device, in accordance with the present invention.

FIG. 30B illustrates the use of an embodiment of a hearing improvement device, in accordance with the present invention. In the illustration of FIG. 30B, hearing improvement device 3000B is held in typical operating position on the ear of a user 3090B by an earhook (not visible) such as that shown in FIG. 30A as earhook 3010A. In the illustration of FIG. 30B, the main housing of hearing improvement device 3000B is positioned behind the outer ear, between a behind-the-ear hearing aid device 3020B and the head of user 3090B.

Figure 31:
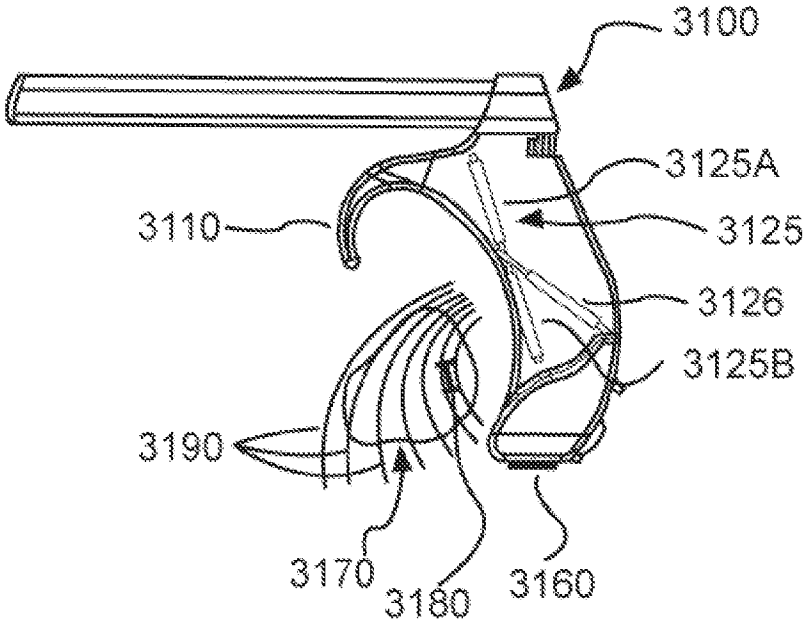
FIG. 31 illustrates the positional relationship during use of a hearing improvement device and an ITE type hearing aid, in accordance with an embodiment of the present invention.

FIG. 31 illustrates the positional relationship during use of a hearing improvement device and an ITE type hearing aid, in accordance with an embodiment of the present invention. In FIG. 31, it can be seen that ITE transmit inductor 3126 of FIG. 31 is positioned at an angle. This arrangement is designed to optimize coupling with a vertically-oriented telecoil that may be located within some ITE-type hearing aids. The lines of magnetic flux 3190 generated by ITE transmit inductor 3126 are illustrated in relation to the ITE hearing aid 3170, and to enclosed telecoil 3180. In an embodiment in accordance with the present invention, the construction and orientation of ITE transmit inductor 3126 has been arranged so that the direction of magnetic flux 3190 is primarily vertical in the region within which ITE hearing aid 3170 may be located, to optimize the influence on a vertically oriented telecoil such as telecoil 3180, that may be contained within ITE type hearing aid 3170.

When considered in combination with the level of sensitivity and environmental noise sources, the relatively large distance separating ITE transmit inductor 3126 from telecoil 3180 increases the importance that the field strength of ITE transmit inductor 3126 be maximized. A higher level of magnetic field strength may be accomplished in an embodiment of the present invention by making the core of ITE transmit inductor 3126 as long as possible within the limitations of the space and orientation available. An important factor influencing the performance of ITE transmit inductor 3126 is its "copper volume", which determines the "crossover" frequency below which the ITE transmit inductor 3126 is primarily resistive in nature. Below the crossover frequency, it becomes increasingly difficult to obtain the field strength that may be needed from a fixed maximum voltage drive. The copper volume selected for use in the ITE transmit inductor 3126 of an embodiment of the present invention results in a relatively low crossover frequency of approximately 400 Hz. The equation presented in relation to FIG. 21 shows that the field-generating efficiency is directly proportional to the length of the core. To maximize the field-generating efficiency, the core is made as long as is practical within the confines of the housing and the required orientation. The core dimensions in an embodiment in accordance with the present invention may be, for example, 0.84" long by 0.03" diameter. The coil may be wound over a length of, for example, 0.49" to an outside diameter of 0.055". The wire gauge and number of turns are chosen to give inductance and resistance values of 26 mH and 96 ohms allow peak currents of 8 milliamps in the resistance-limited lower frequency range, using the class D amplifier 3015 of FIG. 30 operating on a single 1.25 volt hearing aid-style battery. This level of current is sufficient to drive the iron core of ITE transmit inductor 3126 to the edge of saturation, maximizing the magnetic field influencing ITE telecoil 3180. An embodiment in accordance with the present invention may produce maximum field levels of 2 to 4 A/m at typical ITE telecoil positions.

The winding of the BTE transmit inductor 3125 used for coupling to telecoils of BTE-type hearing aids, also depicted as BTE transmit inductor 2926 in FIG. 29, has been divided into two windings that are spaced apart by a distance and positioned on a common core, which are shown as windings 3125A and 3125B in FIG. 31. This split winding arrangement results in an improvement in the uniformity of the magnetic field of BTE transmit inductor 3125. The nature of the magnetic field of BTE transmit inductor 3125 will be discussed in further detail below. The windings of BTE transmit inductor 3125 extend as closely as is practical to the end of the core, in order to maintain a more uniform field near the ends of the core. In an embodiment in accordance with the present invention, the core may have a length of, for example, 1.26", and a diameter of, for example, 0.03". The coil may have an outside diameter of, for example, 0.055" and may be wound to within 0.04" of each end. The central winding gap may be, for example, 0.1". As can be seen in FIG. 31, the winding gap of inductor 3125 may also permit ITE transmit inductor 3126 to overlap the center of BTE transmit inductor 3125 to minimize the overall thickness of the inductor pair, while allowing ITE transmit inductor 3126 to be advantageously positioned to maximize coupling with ITE telecoil 3180. The inductance of BTE transmit inductor 3125 may be, for example, 222 mH, while the resistance may be, for example, 520 Ohms. These values give substantially the same crossover frequency as with ITE transmit inductor 3126.

Figure 32A:
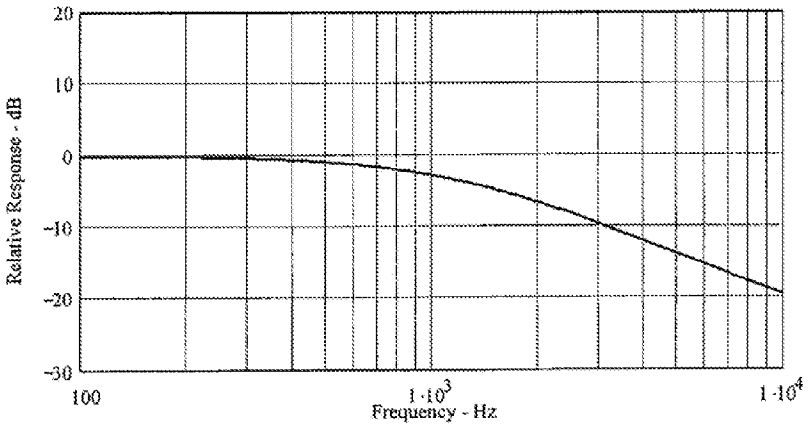
FIG. 32A is a graph which shows the frequency response of a typical amplified telecoil exposed to a magnetic field with a constant, frequency-independent rate-of-change of magnetic flux.

FIG. 32A-32D illustrate the approach used to improve the fidelity of the transmitted signal and the effectiveness of the coupling arrangement in an embodiment in accordance with the present invention. FIG. 32A is a graph which shows the frequency response of a typical amplified telecoil exposed to a magnetic field with a constant, frequency-independent rate-of-change of magnetic flux. This rolloff avoids the excessive brightness sometimes associated with telecoil operation in the past with some magnetic sources, but does not particularly complement the characteristics of prior art tele-couplers.

Figure 32B:
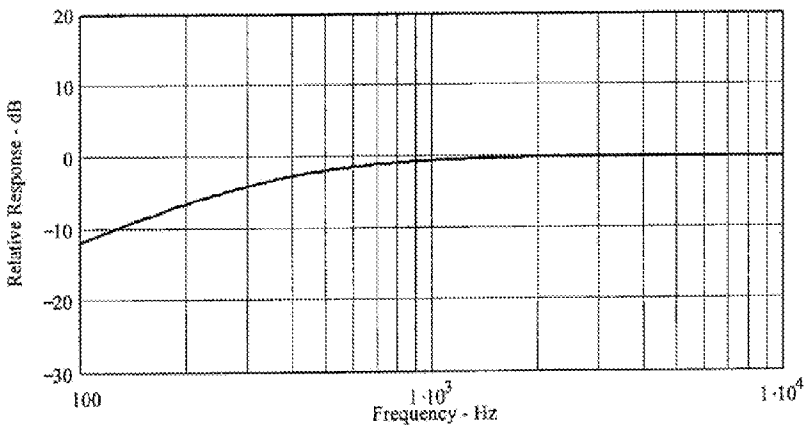
FIG. 32B is a graph of the relative rate-of-change of flux level vs. frequency for a constant applied voltage drive level to a transmit inductor chosen in accordance with an embodiment of the present invention.

FIG. 32B shows a graph of the relative rate-of-change of flux level vs. frequency for a constant applied voltage drive level to a transmit inductor chosen as described above, in accordance with the present invention. In such an embodiment, the inductor resistance dominates over the inductive reactance at frequencies below approximately 400 Hz, resulting in low-frequency roll-off.

Figure 32C:
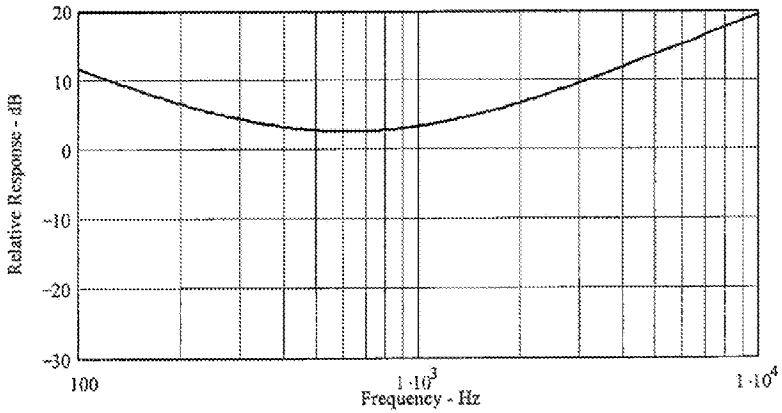
FIG. 32C shows a graph of the theoretical transmit inductor drive voltage required to produce a flat frequency response at the output of the receiving telecoil of a typical modern telecoil application.

FIG. 32C shows a graph of the theoretical transmit inductor drive voltage required to produce a flat frequency response at the output of the receiving telecoil of a typical modern telecoil application. This illustration shows the theoretical frequency-dependent drive voltage response required to compensate for the combined frequency response of the modern telecoil application, as shown in FIG. 32A, and the transmit inductor, as shown in FIG. 32B.

Figure 32D:
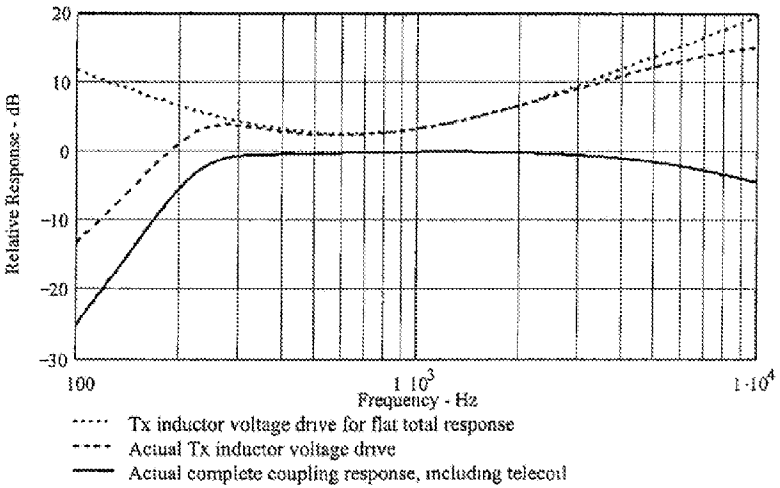
FIG. 32D shows a graph comparing the theoretical transmit inductor drive voltage require for a flat receiving telecoil frequency response as shown in FIG. 32C, the actual transmit inductor drive voltage in accordance with an embodiment of the present invention, and the expected frequency response at the output of the receive telecoil of a modern hearing aid.

FIG. 32D shows a graph comparing the theoretical transmit inductor drive voltage required for a flat receiving telecoil frequency response as shown in FIG. 32C, the actual transmit inductor drive voltage of an embodiment in accordance with the present invention, and the expected frequency response at the output of the telecoil of a modern hearing aid. The high frequency boost in the transmit inductor drive voltage comes from the action of C4 of FIG. 30. The boost at 300 Hz comes from the action of high pass filter 3910 of FIG. 29. The overall magnetic coupling system response is very uniform over the important speech frequency range.

Figure 33:
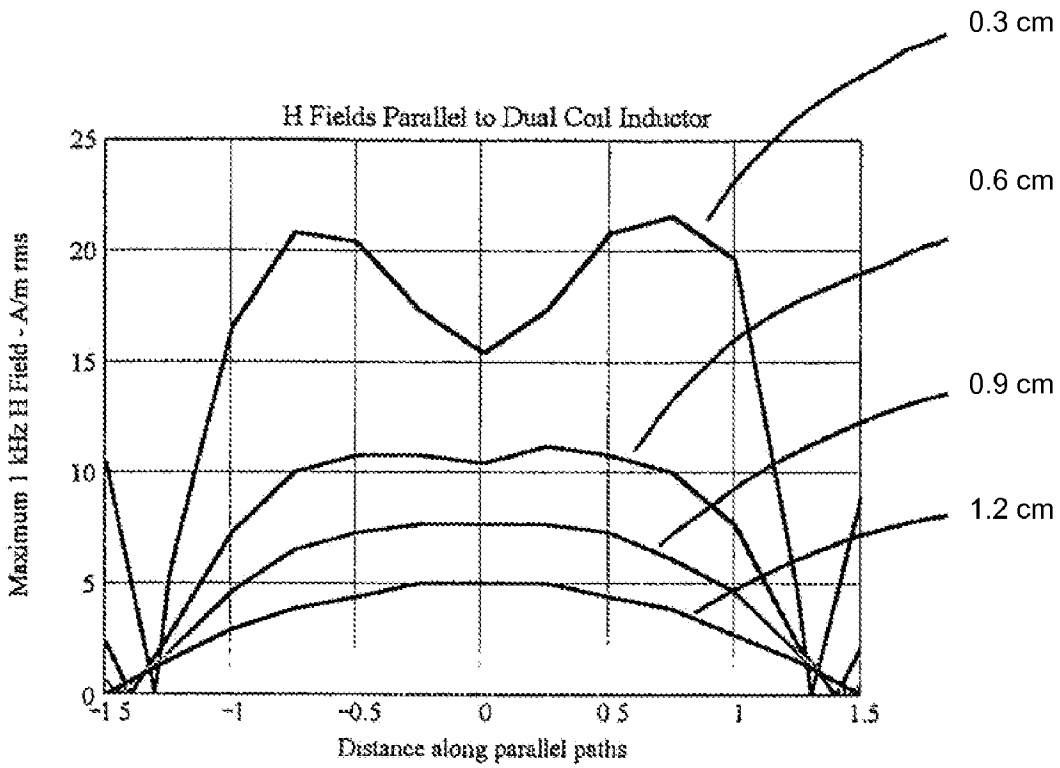
FIG. 33 shows a graph illustrating the field strength of the magnetic field as measured along the length of the BTE transmit inductor of FIG. 31 at different distances from its centerline, in accordance with an embodiment of the present invention.

FIG. 33 shows a graph illustrating the magnetic field strength as measured at different distances from its surface, along the length of BTE transmit inductor 3125 of FIG. 31, in accordance with an embodiment of the present invention. It has been observed that during use, a separation of between 0.5 cm and 0.9 cm may exist between the BTE transmit inductor 3125 in an embodiment of the present invention, and the telecoil in a typical BTE type hearing aid. The magnetic field strength generated by BTE transmit inductor 3125 in a typical use arrangement, as shown in graphs of FIG. 33, and the uniformity of the magnetic field over the length of BTE transmit inductor 3125, demonstrates the effectiveness of the split winding approach in avoiding the buildup of field strength near the center of the inductor that would occur with a continuous winding, and in providing a magnetic field that will be effective in coupling to a variety of BTE-type hearing aids over a range of receiving telecoil positions. An embodiment in accordance with the present invention may produce maximum magnetic field strength levels greater than 5 A/m very uniformly over a wide range of BTE telecoil positions.

Figure 34B:
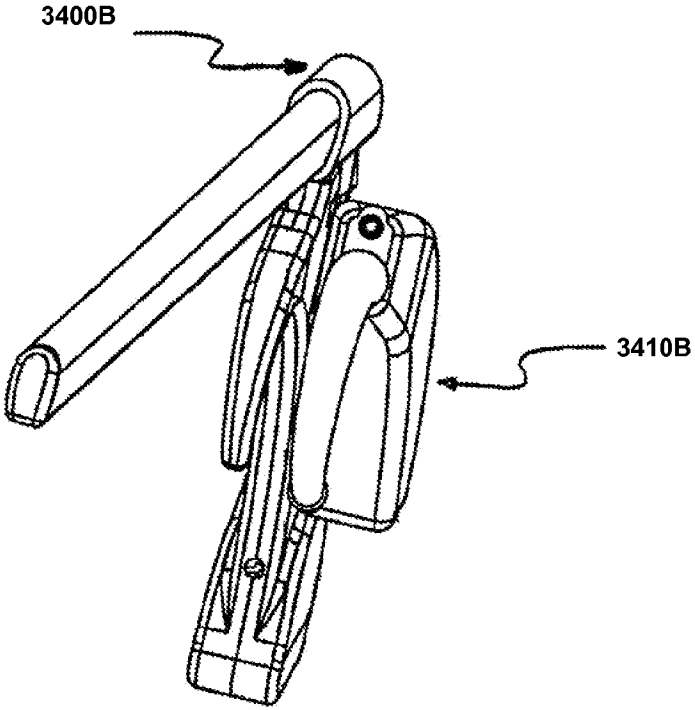
FIG. 34A and FIG. 34B illustrate two views showing right-ear and left-ear use, respectively, of a BTE type hearing aid with an exemplary hearing improvement device in accordance with an embodiment the present invention.
Figure 34A:
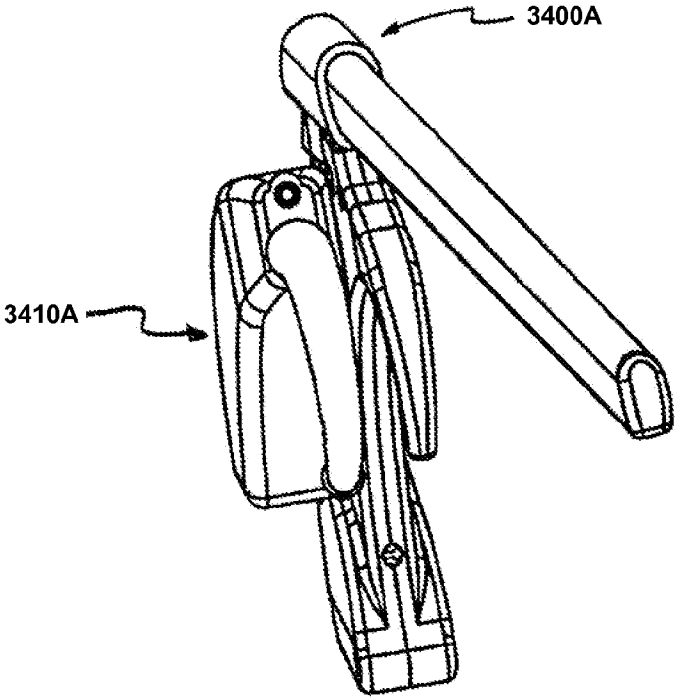

FIG. 34A and FIG. 34B illustrate two views showing right-ear and left-ear use of a BTE type hearing aid with an exemplary embodiment of a hearing improvement device, in accordance with the present invention. In FIG. 34A, BTE hearing aid 3410A is positioned adjacent to hearing improvement device 3400A, which in use would be located behind the right ear and next to the head of a user. Similarly, in FIG. 34B, BTE hearing aid 3410B is positioned adjacent to hearing improvement device 3400B, which during use would be located in a similar manner behind the left ear and adjacent the head of a user. In the arrangement illustrate in each of FIG. 34A and FIG. 34B, the proximity, without attachment, of the BTE hearing aid (3410A, 3410B) to the respective hearing improvement device (3400A, 3400B) provides efficient coupling of the magnetic field generated by the BTE transmit coil within the hearing improvement device, to the receiving telecoil located within the respective BTE type hearing aid, with uniform magnetic coupling strength over a range of possible telecoil positions within the BTE hearing aid housing.

One aspect of the present invention relates to the issue of power consumption. Through the use of the previously described transmit inductor design approach and a class D amplifier, high peak field strengths are achieved with very low idle current from a single 1.25 volt hearing aid-type battery. The three-transistor preamplifier circuit and the class D amplifier shown in FIG. 30A require a total of approximately 165 uA without a transmit inductor load (approximately 60 uA for the transistors and 105 uA for the class-D amplifier). The BTE transmit inductor, such as the one shown in FIG. 29 as BTE transmit inductor 2926, may add only 21 uA to this at idle, while the more powerful ITE transmit inductor, such as ITE transmit inductor 2925 of FIG. 29, may add 71 uA at idle. Although the operating current does go higher transiently when louder sounds are being coupled, the duration of this higher current drain is extremely short and highly intermittent, and does not have an appreciable effect upon battery life. In an embodiment of the present invention, battery life is determined primarily by the idle currents. The total current drain, including approximately 200 uA for the array microphone described above, is approximately 386 uA using the BTE transmit inductor, and approximately 436 uA using the ITE transmit inductor. This results in an estimated battery life of approximately 181 hours (BTE transmit inductor active) or 161 hours (ITE transmit inductor active) from a size 10A zinc-air hearing aid battery of 70 mA-hour capacity. These levels are very low average current drains for the high peak magnetic field strengths produced.

Figure 35A:
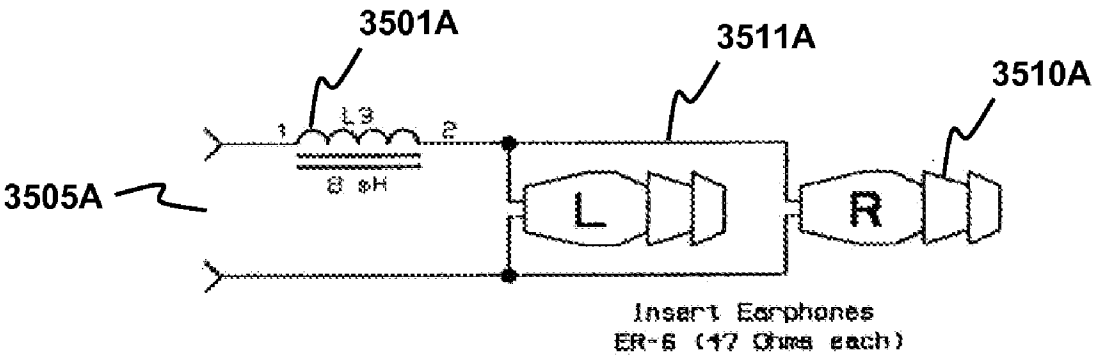
FIG. 35A shows a schematic diagram illustrating the interconnection of a pair of earphones suitable for use with the embodiment shown in FIG. 35, in accordance with an embodiment of the present invention.
Figure 35:
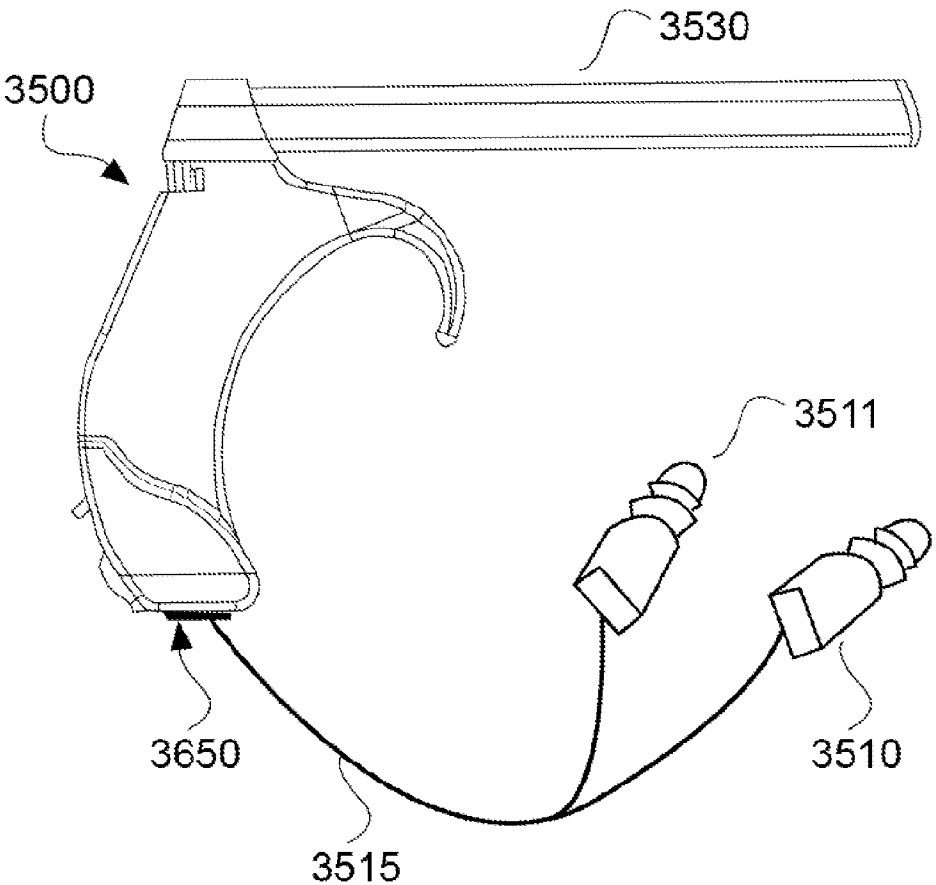
FIG. 35 illustrates a further embodiment in which an earphone is directly connected to the hearing improvement device, in accordance with the present invention.

FIG. 35 illustrates a further embodiment in which an earphone is directly connected to the hearing improvement device, in accordance with the present invention. In the embodiment illustrated in FIG. 35, array microphone 3530 transduces a sound field into an electrical signal, which is amplified by the circuitry within hearing improvement device 3500 as described above, and made available at connector 3560. The circuitry of hearing improvement device 3500 may correspond, for example, to the schematic illustrated in FIG. 30. The directionality of array microphone 3530 allows the user to orient array microphone 3530 so as to emphasize those sounds of most interest to the user. In the exemplary embodiment of FIG. 35, earphones 3510 and 3511, which may be, for example, earphones such as the Etymotic Research model ER-6 insert earphone, are operatively coupled to connector 3560 by multi-conductor cable 3515. Connector 3560 may correspond to connector 3060 as shown in FIG. 30. Although two earphones are shown in FIG. 35, a lesser or greater number may be used without departing from the spirit of the invention.

FIG. 35A shows a schematic diagram illustrating the interconnection of a pair of earphones suitable for use with the embodiment shown in FIG. 35, in accordance with the present invention. Returning to the illustration shown in FIG. 30, it can be seen that in addition to driving the ITE or BTE transmit inductors 3025 and 3026, respectively, the class-D amplifier 3015 is also arranged to provide the amplifier output signal through a 22 uF capacitor, for external direct connection of an earphone assembly at connector 3060. An earphone assembly that may be suitable for such use is shown in FIG. 35A. In FIG. 35A, earphones 3510A and 3511A receive audio electrical signals from connector 3565A through inductor 3501A, which may have a value of 8 mH. Inductor 3501A may be used to filter the 100 kHz switching currents that may be present in the output signal of the class-D amplifier 3015. Use of inductor 3501A significantly reduces the current drain of hearing improvement device that would otherwise occur if earphones 3510A and 3511A received signals directly from connector 3060 of FIG. 30. Inductor 3501A also introduces a high frequency roll-off similar to that introduced by the characteristics of the receive telecoil in an inductively coupled hearing aid. To compensate for such high-frequency roll-off, high frequency boost has been provided by the action of capacitor C4 of FIG. 30. A small boost in the transmitter response just above the cutoff frequency of approximately 230 Hz provided by Q1 and its associated parts, C1, C2, R1, and R2, for use with ITE and BTE transmit inductors, may not be needed when using earphones 3510A and 3511A. This unnecessary boost is reduced by the action of output coupling capacitor C9. The net result is that the earphone receives a final frequency response substantially similar to that shown in FIG. 32D, as previously discussed.

Figure 36:
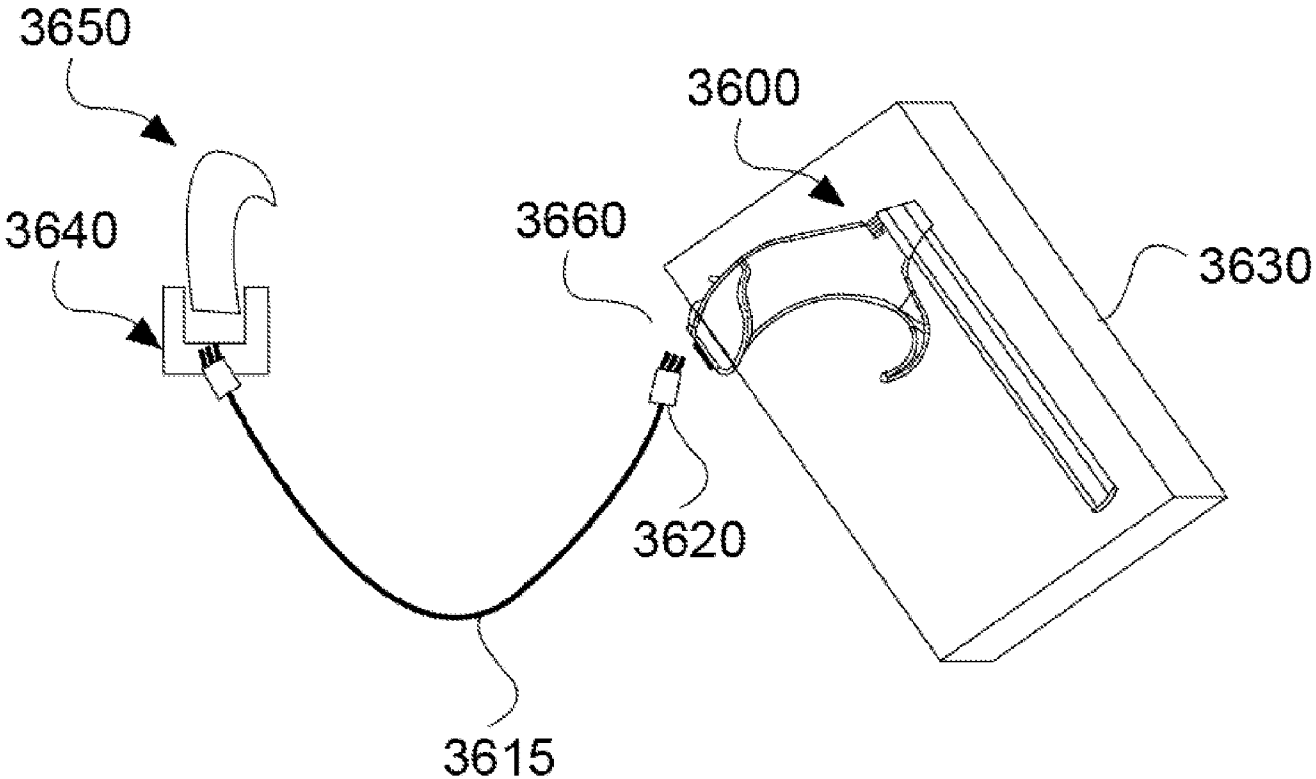
FIG. 36 illustrates an additional embodiment in which a hearing improvement device is directly coupled to the hearing aid of a user, in accordance with the present invention.

FIG. 36 illustrates an additional embodiment in which a hearing improvement device is directly coupled to the hearing aid of a user, in accordance with the present invention. Such an arrangement may enable a user to reduce background noise and improve intelligibility by allowing the substitution of the array microphone within hearing improvement device 3600 for the internal microphone of hearing aid 3650, permitting the user to direct the array microphone of hearing improvement device 3600 at the sound source of interest. In the illustration of FIG. 36, the BTE type hearing aid 3650 is electrically connected to hearing improvement device 3600, which may correspond to the hearing improvement devices depicted in FIG. 31 and FIG. 34A or 34B. Connector 3620 at one end of multi-conductor cable 3615 is inserted into mating connector 3660 on the hearing improvement device 3600. Connector 3660 may correspond to connector 3160 in FIG. 31. Boot 3640 at the remaining end of multi-conductor cable 3615 connects to BTE hearing aid 3650, supplying amplified audio signals from the array microphone contained within hearing improvement device 3600 directly to BTE hearing aid 3650. To avoid damage that may occur should hearing improvement device 3600 be dropped or struck and to provide a less noticeable visual appearance, hearing improvement device 3600 may be protected within enclosure 3630.

Aspects of the present invention can be found in a hearing improvement device comprising at least one input for accepting a first electrical signal, for example the signal from a microphone, at least one filter for modifying the first electrical signal producing a second electrical signal, and at least one inductor for converting the second electrical signal into a magnetic field for coupling to the telecoil of a hearing aid. In an embodiment according to the present invention, the at least one filter may further comprise a high pass filter for attenuating the low frequency spectral components of the first electrical signal, the filter producing an output; and an amplifier for amplifying the output of the high pass filter, the amplifier producing the second electrical signal. The amplifier may be a class D amplifier. An embodiment may further comprise a switch operatively connected to the amplifier for enabling and disabling a fixed amount of amplification. In addition, the winding of the at least one inductor may comprise a first winding portion and a second winding portion. The first and second winding portions may be separated by an intervening gap, and the winding portions may be disposed on a common core in order to produce a more uniform magnetic field. The at least one input in an embodiment of the present invention may accept a signal from a directional microphone, and such microphone specifically may be an array microphone. The array microphone may comprise a plurality of microphones aligned in an array for generating a plurality of individual microphone electrical signals from sound energy received, a plurality of summation points for adding the plurality of individual microphone electrical signals to generate the first electrical signal, and a single signal wire electrically connecting the plurality of summation points.

In an embodiment of the present invention, the at least one inductor may comprise at least two inductors. A first inductor may convert the second electrical signal into a magnetic field for coupling to the telecoil of a first type of hearing aid, and a second inductor may convert the second electrical signal into a magnetic field for coupling to the telecoil of a second type of hearing aid. The first type hearing aid may be an in the ear type hearing aid, and the second type hearing aid may be a behind the ear type hearing aid An embodiment may also comprise a switch for selecting at least one of the first inductor and the second inductor. An embodiment in accordance with the present invention may comprise a connector for coupling the second electrical signal to an external device, and the total idle operating current may be less than 500 microamps. The maximum field strength of the magnetic field measured at 1 KHz may be greater than 20 mA/m, and the microphone, the at least one filter, and the at least one inductor may be contained within a single unit.

Another aspect of the present invention may be seen in a hearing improvement device comprising at least one microphone for transducing sound into a first electrical signal, at least one filter for modifying the first electrical signal, the at least one filter producing a second electrical signal, and a connector for connecting the second electrical signal to the hearing aid of a user. The at least one microphone in such an embodiment may be an array microphone. The at least one filter may comprise a high pass filter for attenuating the low-frequency spectral components of the first electrical signal, and an amplifier for amplifying the high pass filtered first electrical signal, the amplifier producing a second electrical signal.

An additional aspect of the present invention may be a method of operating a hearing improvement device, where the method comprises receiving a sound field, tranducing the sound field into a first electrical signal, filtering the first electrical signal to produce a second electrical signal, converting the second electrical signal into a magnetic field, and coupling the magnetic field to the telecoil of a hearing aid. The filtering may comprise high pass filtering the first electrical signal and amplifying the high pass filtered first electrical signal to produce the second electrical signal. The converting may comprise selecting at least one of a first mode of conversion and a second mode of conversion, and converting the second electrical signal into a magnetic field using the selected mode of conversion. In such an embodiment, the first mode of conversion may be optimized for coupling with a first type of hearing aid, and the second mode of conversion may be optimized for coupling with a second type of hearing aid. The first type hearing aid may be an in the ear type hearing aid, and the second type of hearing aid may be a behind the ear type hearing aid. In addition, the transducing, filtering, converting, and coupling may be performed within a single unit. In an embodiment in accordance with the present invention, the field strength of the maximum magnetic field measured at 1 KHz may be greater than 20 mA/m, and the total idle operating current may be less than 500 microamps.

Yet another aspect of an embodiment of the present invention may be seen in a method of operating a hearing improvement device, the method comprising receiving a sound field, transducing the sound field into a first electrical signal, filtering the first electrical signal producing a second electrical signal, and coupling the second electrical signal to a hearing aid. In such an embodiment, the filtering may comprise high pass filtering the first electrical signal, and amplifying the high pass filtered first electrical signal to produce the second electrical signal.

Notwithstanding, the invention and its inventive arrangements disclosed herein may be embodied in other forms without departing from the spirit or essential attributes thereof. Accordingly, reference should be made to the following claims, rather than to the foregoing specification, as indicating the scope of the invention. In this regard, the description above is intended by way of example only and is not intended to limit the present invention in any way, except as set forth in the following claims.

While the present invention has been described with reference to certain embodiments, it will be understood by those skilled in the art that various changes may be made and equivalents may be substituted without departing from the scope of the present invention. In addition, many modifications may be made to adapt a particular situation or material to the teachings of the present invention without departing from its scope. Therefore, it is intended that the present invention not be limited to the particular embodiment disclosed, but that the present invention will include all embodiments falling within the scope of the appended claims.

What is claimed is:

1. A method of operating a hearing improvement device suitable for wearing proximate an ear of a user, the method comprising:

selecting from a plurality of predefined magnetic field orientations, wherein the plurality of magnetic field orientations comprises a first magnetic field orientation arranged for coupling to a behind the ear type hearing aid and a second magnetic field orientation arranged for coupling to an in the ear type hearing aid; and generating a magnetic field having the selected magnetic field orientation using an electrical signal representative of sound, the magnetic field for coupling to a telecoil of a hearing aid.

2. The method according to claim 1, wherein the plurality of magnetic field orientations comprises two magnetic field orientations.

3. The method according to claim 1, wherein the first inductor is configured to generate the first magnetic field orientation, and a second inductor is configured to generate the second magnetic field orientation.

4. The method according to claim 1, further comprising: converting sound into the electrical signal representative of sound.

5. The method according to claim 1, further comprising: receiving the electrical signal representative of sound.

6. The method according to claim 1, wherein the hearing improvement device is positioned behind an ear of the user.

7. A hearing improvement system comprising:

a hearing aid for directing sound into an ear canal of a user; and a housing arranged to fit substantially behind an ear of the user, the housing comprising:

a microphone having a relatively greater sensitivity to sound in the direction faced by the user, the microphone for converting sound into an electrical signal;

at least one inductor for producing, using the electrical signal, a magnetic field for coupling to a telecoil of the hearing aid, wherein the at least one inductor comprises at least two inductors each generating a magnetic field having a different field orientation; and a battery.

8. The hearing improvement system of claim 7, wherein the hearing aid is a behind-the-ear type hearing aid.

9. The hearing improvement system of claim 7, wherein the housing further comprises switch circuitry for selecting among the at least one inductor.

10. The hearing improvement system of claim 7, wherein the microphone comprises an array microphone.

11. The hearing improvement system of claim 7, wherein the housing further comprises an amplifier for modifying the electrical signal.

12. A hearing improvement device comprising:

an amplifier for modifying an electrical signal representative of sound;

at least one inductor for generating, from the modified electrical signal, a magnetic field suitable for coupling to the telecoil of a hearing aid; and a housing suitably arranged for wearing proximate an ear of a user, wherein the housing contains the at least one inductor, the amplifier, and a battery, wherein the housing is suitably arranged to fit behind an ear of a user, and wherein the housing is arranged to be collocated with a behind-the-ear (BTE) type hearing aid.

13. The hearing improvement device of claim 12, further comprising a microphone for converting sound into the electrical signal representative of sound.

14. The hearing improvement device of claim 13, wherein the microphone comprises a directional microphone.

15. The hearing improvement device of claim 14, wherein the microphone is an array microphone.

16. The hearing improvement device of claim 12, further comprising switch circuitry for passing the modified electrical signal to a selected one of the at least one inductor.

17. The hearing improvement device of claim 12, further comprising a first electrical connector portion that when mated with a second electrical connector portion enables the passage of the electrical signal representative of sound.

18. The hearing improvement device of claim 12, wherein the at least one inductor comprises at least two inductors each generating a magnetic field having a different field orientation.

19. The hearing improvement device of claim 12, further comprising an ear hook for supporting the device from an ear of a user.

20. A hearing improvement device comprising:

an amplifier for modifying an electrical signal representative of sound;

at least one inductor for generating, from the modified electrical signal, a magnetic field suitable for coupling to the telecoil of a hearing aid, wherein the at least one inductor comprises at least two inductors each generating a magnetic field having a different field orientation; and a housing suitably arranged for wearing proximate an ear of a user, wherein the housing contains the at least one inductor, the amplifier, and a battery.

21. The hearing improvement device of claim 20, further comprising a microphone for converting sound into the electrical signal representative of sound.

22. The hearing improvement device of claim 21, wherein the microphone comprises a directional microphone.

23. The hearing improvement device of claim 22, wherein the microphone is an array microphone.

24. The hearing improvement device of claim 20, further comprising switch circuitry for passing the modified electrical signal to a selected one of the at least one inductor.

25. The hearing improvement device of claim 20, wherein the housing is suitably arranged to fit behind an ear of a user.

26. The hearing improvement device of claim 25, wherein the housing is arranged to be collocated with a behind-the-ear (BTE) type hearing aid.

27. The hearing improvement device of claim 20, further comprising a first electrical connector portion that when mated with a second electrical connector portion enables the passage of the electrical signal representative of sound.

28. The hearing improvement device of claim 20, further comprising an ear hook for supporting the device from an ear of a user.

* * * * *

UNITED STATES PATENT AND TRADEMARK OFFICE

CERTIFICATE OF CORRECTION

PATENT NO. : 7,522,740 B2
APPLICATION NO. : 11/345567
DATED : April 21, 2009
INVENTOR(S) : Julstrom et al.

It is certified that error appears in the above-identified patent and that said Letters Patent is hereby corrected as shown below:

On the title page item (60) delete “, provisional application No. 60/123,004, filed on Mar. 5, 1999”.

In the specification

Column 1, line 18, delete “and Ser. No. 60/123,004”.

Column 1, line 19, delete “filed Mar. 5, 1999,”.

Signed and Sealed this
Nineteenth Day of January, 2016

Michelle K. Lee

Michelle K. Lee
*Director of the United States Patent and Trademark Office*